US008192464B2

(12) United States Patent
Hakim

(10) Patent No.: US 8,192,464 B2
(45) Date of Patent: Jun. 5, 2012

(54) PACIFIER SHIELDS

(75) Inventor: Nouri E. Hakim, Monroe, LA (US)

(73) Assignee: Luv n' care, Ltd., Monroe, LA (US)

( * ) Notice: Subject to any disclaimer, the term of this patent is extended or adjusted under 35 U.S.C. 154(b) by 370 days.

(21) Appl. No.: 11/904,037

(22) Filed: Sep. 25, 2007

(65) Prior Publication Data

US 2008/0188894 A1 Aug. 7, 2008

Related U.S. Application Data

(60) Division of application No. 10/108,229, filed on Mar. 27, 2002, now abandoned, which is a continuation-in-part of application No. 09/790,254, filed on Feb. 22, 2001, now abandoned, which is a continuation of application No. 09/271,395, filed on Mar. 17, 1999, now Pat. No. 6,241,110.

(60) Provisional application No. 60/097,547, filed on Aug. 21, 1998, provisional application No. 60/279,317, filed on Mar. 28, 2001.

(51) Int. Cl.
*A61J 17/00* (2006.01)

(52) U.S. Cl. ..... 606/234; 215/11.1; 606/236

(58) Field of Classification Search ..... 606/234, 606/235, 236; 215/11.1–11.5; 264/273, 264/645, 478

See application file for complete search history.

(56) References Cited

U.S. PATENT DOCUMENTS

| | | | | | |
|---|---|---|---|---|---|
| 3,474,185 | A | * | 10/1969 | Ahearn, Jr. et al. | 174/524 |
| 4,402,321 | A | * | 9/1983 | Berg | 606/236 |
| 4,688,571 | A | * | 8/1987 | Tesler | 606/234 |
| 5,078,734 | A | * | 1/1992 | Noble | 604/77 |
| 5,275,619 | A | * | 1/1994 | Engebretson et al. | 606/236 |
| 5,792,407 | A | * | 8/1998 | Berzack | 264/229 |
| 6,032,810 | A | * | 3/2000 | Meyers et al. | 215/11.1 |

* cited by examiner

*Primary Examiner* — Tuan Nguyen
(74) *Attorney, Agent, or Firm* — Goldberg Cohen LLP

(57) ABSTRACT

A multistage baglet system for a pacifier and a multistage nipple system. Baglets and nipples with bumps thereon are initially provided to accustom a baby to the use of such baglets and nipples. Subsequently, baglets and nipples with bumps are provided to assist the baby with teething.

10 Claims, 27 Drawing Sheets

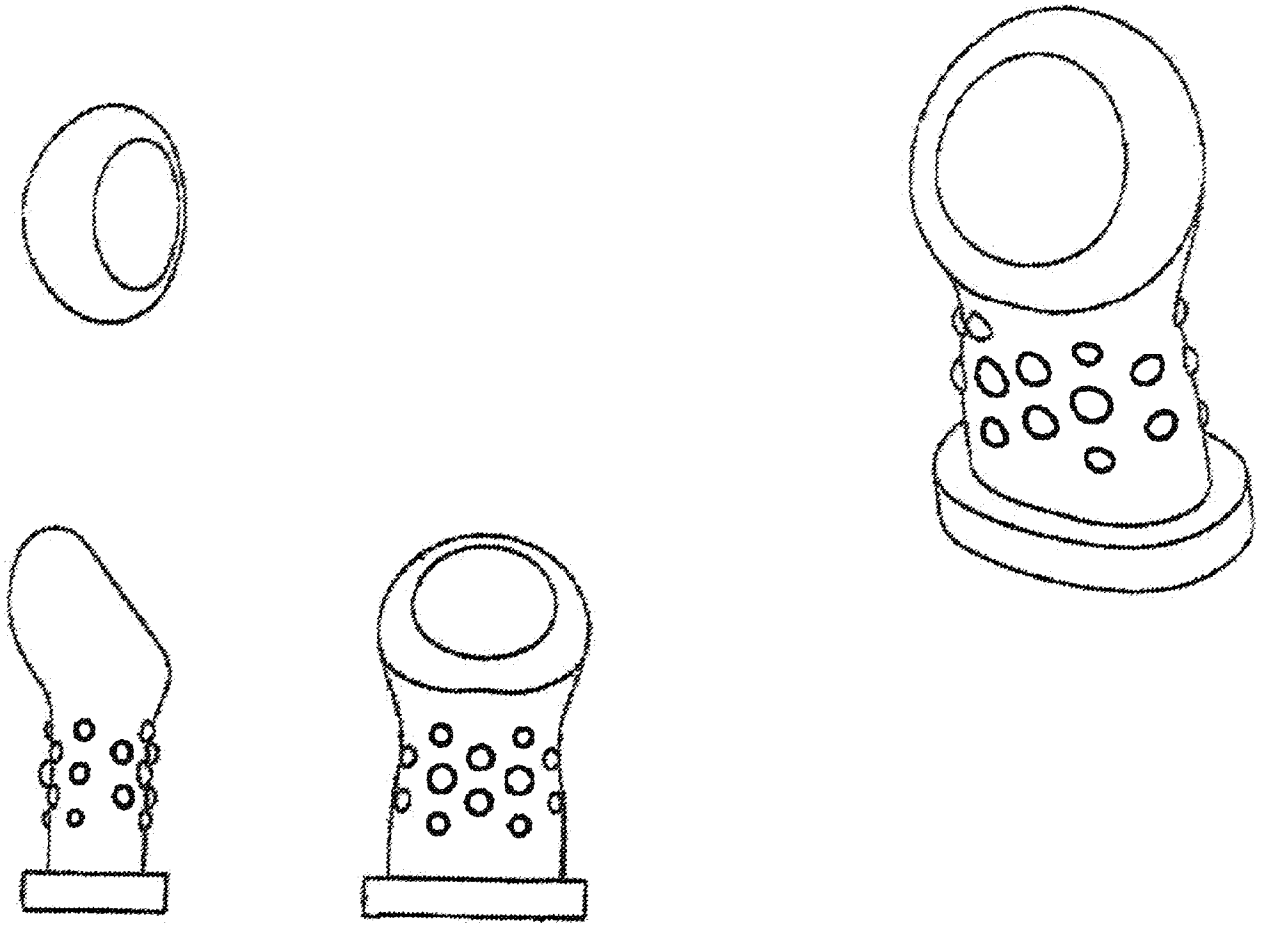
STAGE 1 FIG-15A

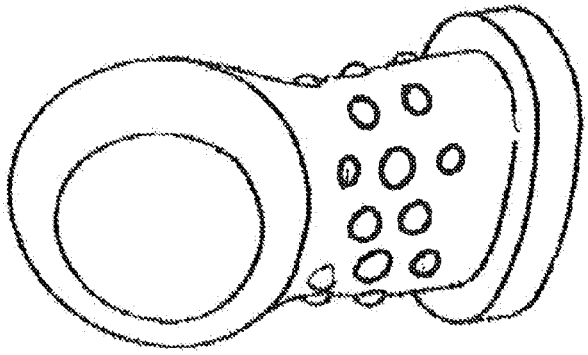
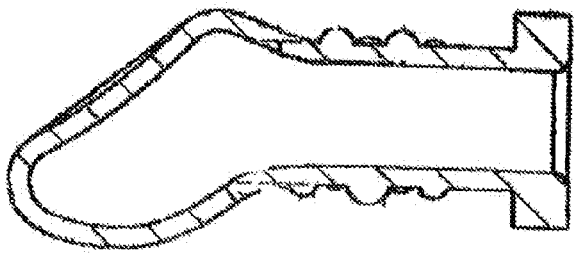
STAGE I (DETAIL)
FIG-15B
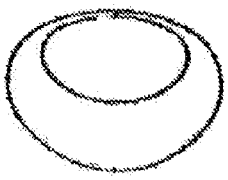

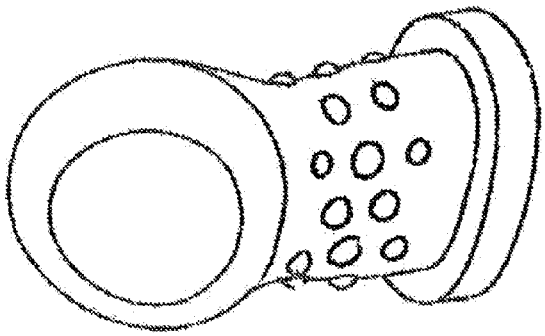
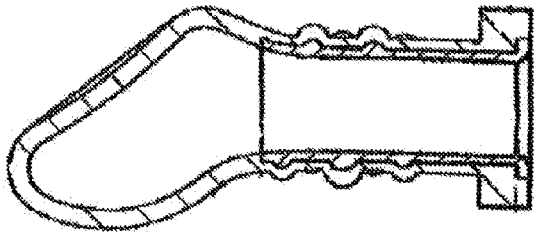
STAGE 2 FIG-16
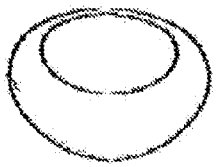

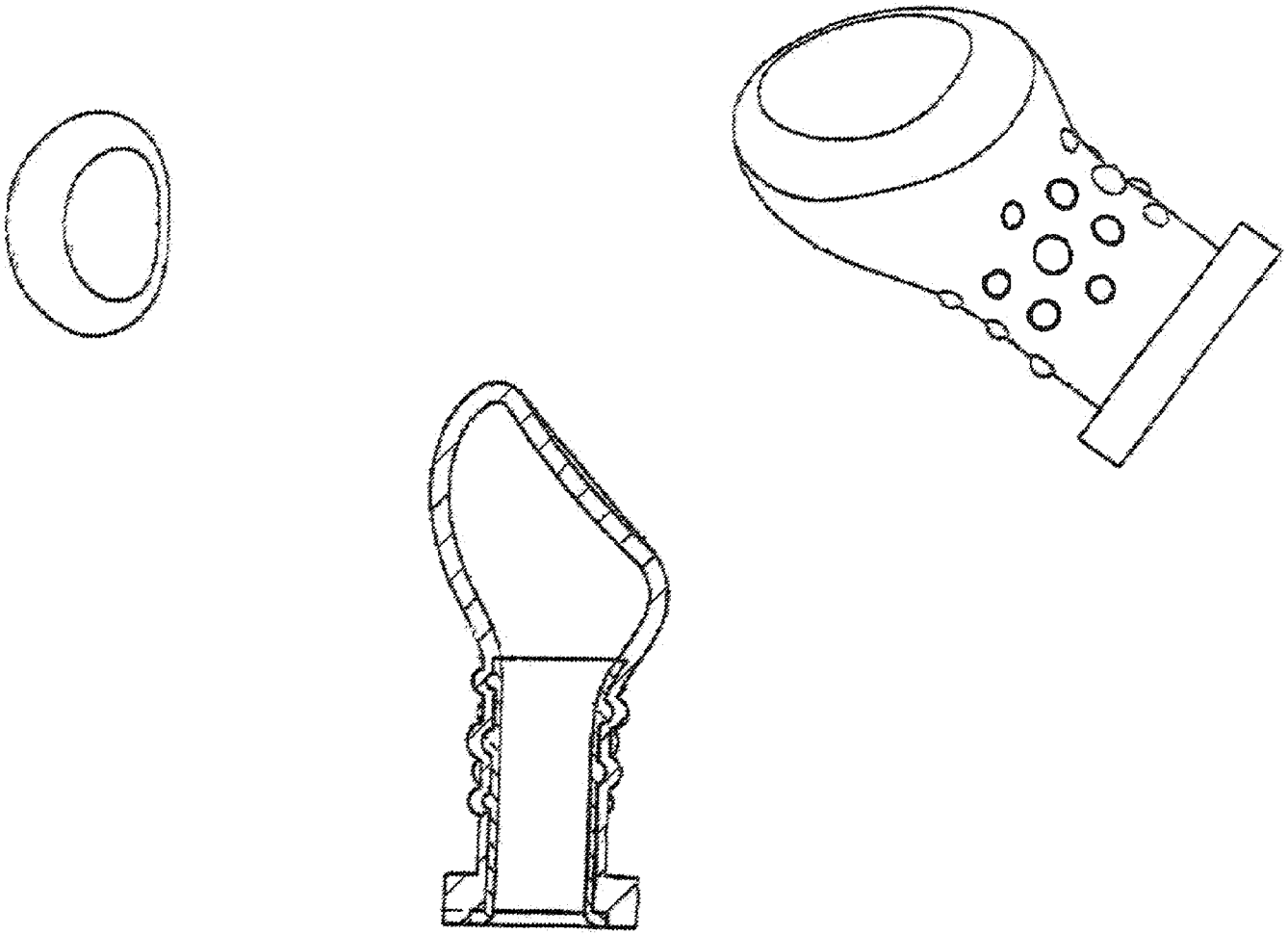
STAGE 3 FIG 17

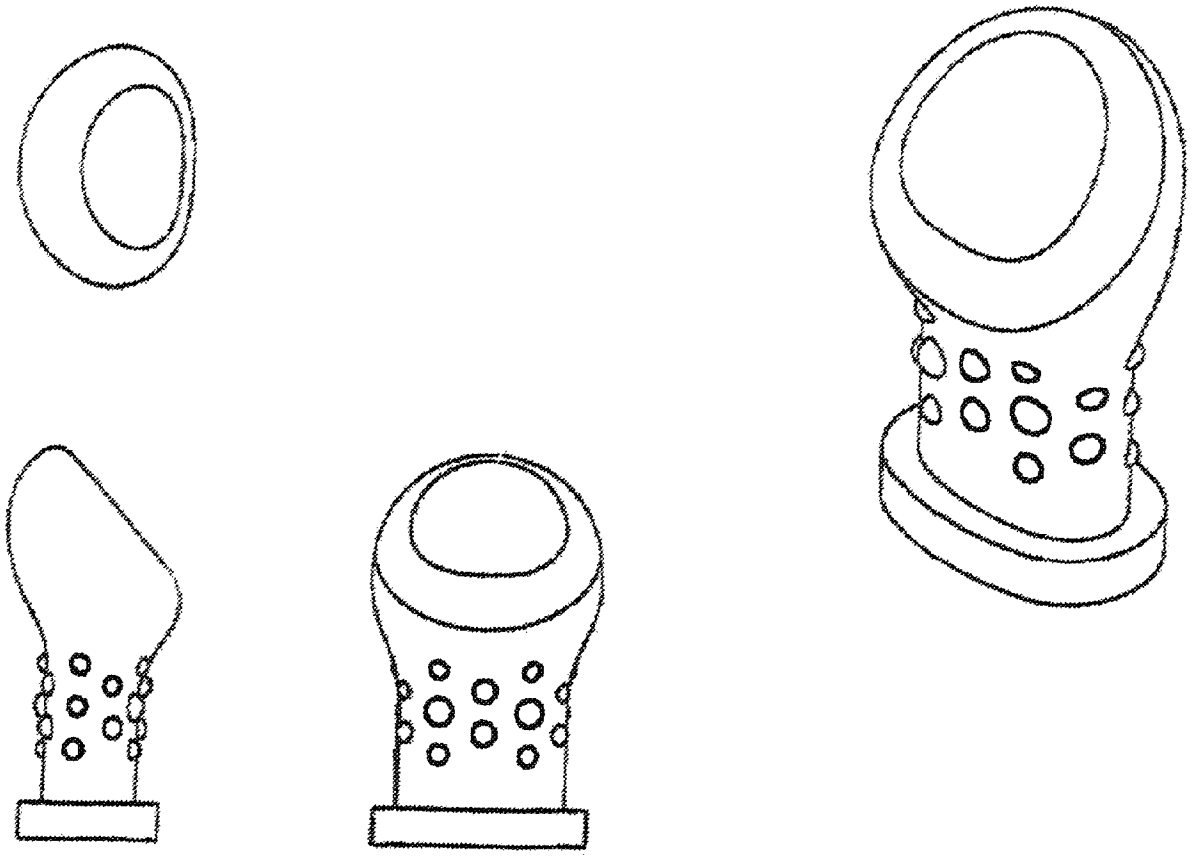
STAGE 4 FIG. 18A

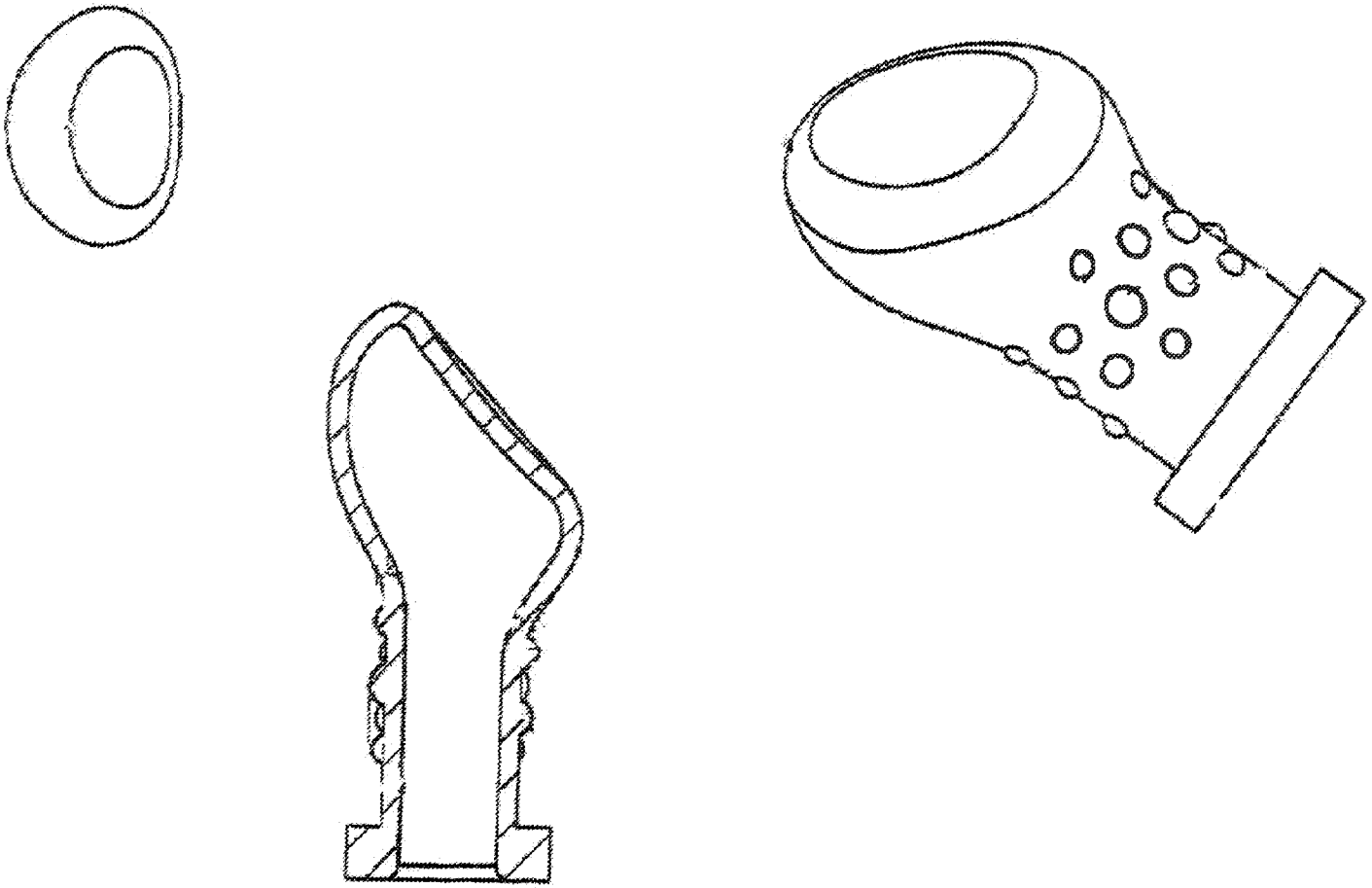
STAGE 4 (DETAIL) FIG. 13B

PACIFIER SHIELDS

RELATED APPLICATIONS

This application is a divisional of U.S. patent application Ser. No. 10/108,229 filed Mar. 27, 2002 (abandoned) ("the '229 application"), which is a continuation-in-part of U.S. Nonprovisional application Ser. No. 09/790,254 filed Feb. 22, 2001 (abandoned) ("the '254 application"), which is a continuation of U.S. Nonprovisional application Ser. No. 09/271,395 filed Mar. 17, 1999, (patented, U.S. Pat. No. 6,241,110), which claims the benefit of U.S. Provisional Application Ser. No. 60/097,547 filed Aug. 21, 1998. The '229 application also claims the benefit of U.S. Provisional Application Ser. No. 60/279,317 filed Mar. 28, 2001. The benefit of all of those prior applications is claimed, and the disclosures of all of those applications are fully incorporated herein by reference.

FIELD OF THE INVENTION

The present invention is directed to improved baby products, such as children's pacifiers, baglets, and baby bottle nipples. The present invention is also directed to methods for construction of such products.

SUMMARY OF THE INVENTION

In accordance with one embodiment of the present invention, a combination pacifier shield is provided having at least two components of different compositions or hardnesses. In a preferred embodiment, the pacifier includes a soft shield component which rests against a child's face and a hard shield backing component which improves the overall structural integrity of the shield and pacifer.

In a further preferred embodiment of the invention, a combination baglet is provided. As is well known in the art, the baglet is the portion of a pacifier that a child sucks on, and the nipple is the portion of a baby bottle that the child sucks on to drink therefrom. The term baglet is generally used in the art with reference to pacifiers, and the term nipple with respect to baby bottles. In the present application, however, including both the specification and claims, the term baglet is broadly used to refer to both baglets of pacifiers and nipples of baby bottles for the sake of clarity and ease of discussion.

In accordance with the present invention, the combination baglet has at least two components of different hardnesses provided therein. In one preferred embodiment, the baglet has soft and hard components. In one such embodiment, silicones are used of different hardnesses. The soft component is preferably any of the traditional materials used in the art for a traditional baglet. The hard components, in contrast, are preferably harder raised portions or bumps which are provided on or in the baglet for a baby to teethe on.

In an additional or alternative embodiment, the baglet has bumps thereon to assist the baby with teething. These bumps preferably comprise raised sections or areas on the baglet (although they can alternately be depressed sections), which rub against the baby or child's gums. The bumps can be of any desired shape or configuration.

Further embodiments of the invention will be apparent in conjunction with the drawings and the detailed disclosure herein.

BRIEF DESCRIPTION OF THE FIGURES

FIG. 15A includes several views of a first stage baglet in accordance with the present invention. F*ig*. 15B includes more detailed views of the drawings in FIG 15A.

FIG. 16 includes several views of a second stage baglet in accordance with the present invention.

FIG. 17 includes several views of a third stage baglet in accordance with the present invention.

FIG. 18A includes several views of a fourth stage baglet in accordance with the present invention. FIG. 18B includes more detailed views of the drawings in FIG. 18A.

DETAILED DESCRIPTION OF THE INVENTION AND THE PREFERRED EMBODIMENTS

The present invention is directed to improved child and infant pacifiers, baglets and nipples and to methods for pacifier, baglet and nipple construction. In a first preferred embodiment, the baglets and nipples are each constructed of a single hardness material (i.e. material of a single durometer), with bumps or other protrusions thereon. In a further preferred embodiment, the invention is directed to improved pacifier baglets and nipples having portions provided thereon or therein which are harder than the remainder of the baglet or nipple, to provide a baby with harder durometer sections on which the baby can teethe.

In a first embodiment of the invention, the invention is directed to child and infant pacifier shields. In the present state of the art, although polypropylene is an available material for children's pacifier shields, it is also, practically speaking, a very hard material for a child or infant's daily use. If a child falls down while he or she has a pacifier in his or her mouth having a shield constructed from polypropylene, the polypropylene material will make a hard impact on the child's face, thereby potentially causing the child pain or injury.

Kraton, on the other hand, is a soft, spongy, material. Yet, although Kraton is a much more comfortable material for resting against the mouth of a child, for safety considerations a pacifier or pacifier shield cannot be wholly constructed out of it. If the entire pacifier or pacifier shield were made of Kraton, the pacifier would fail the butterfly gauge test, i.e. the two (2) lb. pull test which all pacifiers must be able to pass under consumer safety regulations.

Accordingly, pursuant to one embodiment of the present invention, a combination material pacifier is provided. The pacifier shield includes a Kraton pacifier shield component, which rests against the baby's skin, and a polypropylene pacifier shield component which serves as a backing. The Kraton shield shield component provides a soft, spongy material next to the baby's face and softens any impact if the baby falls with the pacifer in its mouth. In addition, the Kraton component also covers the edges of the pacifier, so that the edges of the pacifier are soft and cushioned, as well. Thus, pacifier edges will not scratch or hurt the child's face or be unduly uncomfortable.

Figure 1:
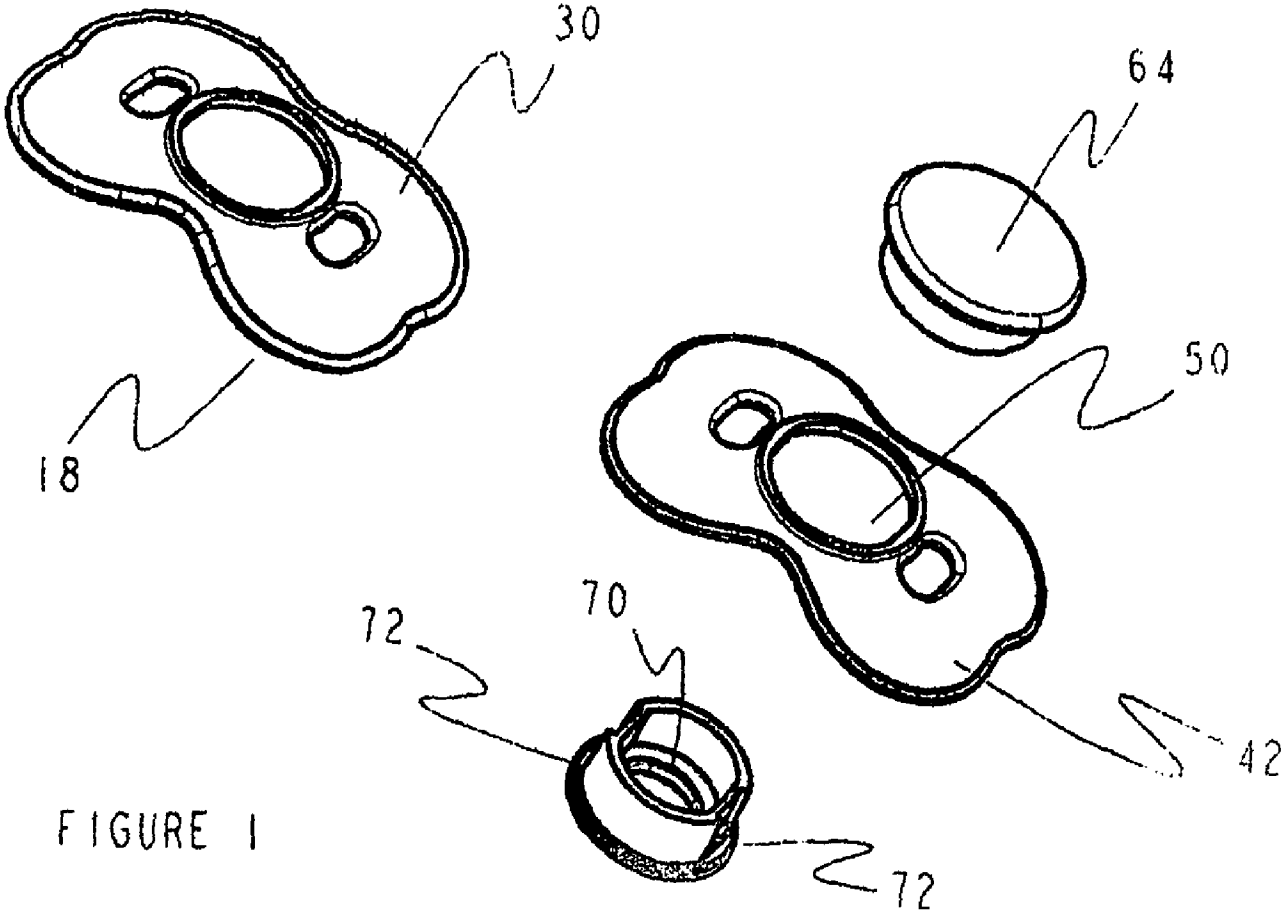
FIG. 1 is an exploded, perspective view of a first embodiment of the pacifier shield of the present invention.
Figure 2:
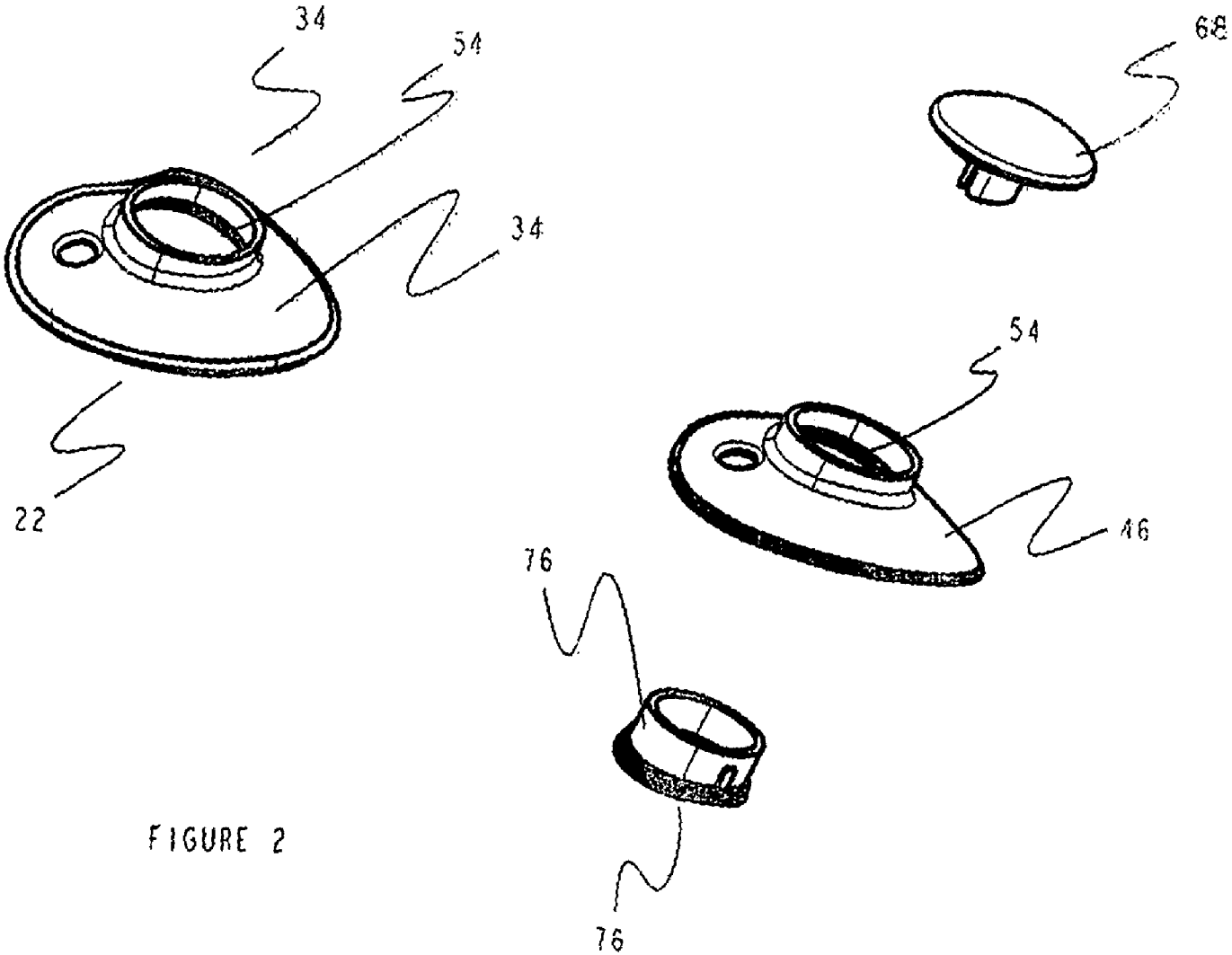
FIG. 2 is an exploded, perspective view of a second embodiment of the pacifier shield of the present invention.

Further details of the invention will be apparent with reference to FIGS. 1 and 2. FIG. 1 is an exploded, perspective view of a first embodiment of the invention in which the invention includes a butterfly style shield. FIG. 2 is an exploded, perspective view of a second embodiment of the invention which uses an ortho ("nuk") style shield.

In the present state of the art, it is not believed to be possible to sonic weld materials to polypropylene. In fact, polypropylene cannot even be sonic welded to itself consistently. Consequently, the Kraton and polypropylene components cannot be sonic welded to each other.

Accordingly, pursuant to the present invention, a new construction method for constructing a composite pacifier shield is provided as shown in FIGS. 1 and 2. In a preferred embodiment, the composite shield includes at least two components, a hard shield component and a softer shield component.

As shown in FIG. 1, pacifier 18 is provided having a composite pacifier shield which includes a Kraton shield 30 directly secured to a polypropylene shield 42. In the preferred embodiment, the Kraton shield 30 is insert molded onto polypropylene shield 42. This can be effected by compression molding, by injection molding, or transfer molding, using the molding techniques known in the art. In the preferred embodiment, the polypropylene is molded at approximately 290-390 degrees F. The polypropylene is then maintained at approximately 70-110 degrees F., and the Kraton component is molded thereon. The Kraton is preferably molded on when it is at a temperature of approximately 290-390 degrees F. This heating of the polypropylene and the Kraton assists the Kraton in physically bonding to the polypropylene material.

Figure 12:
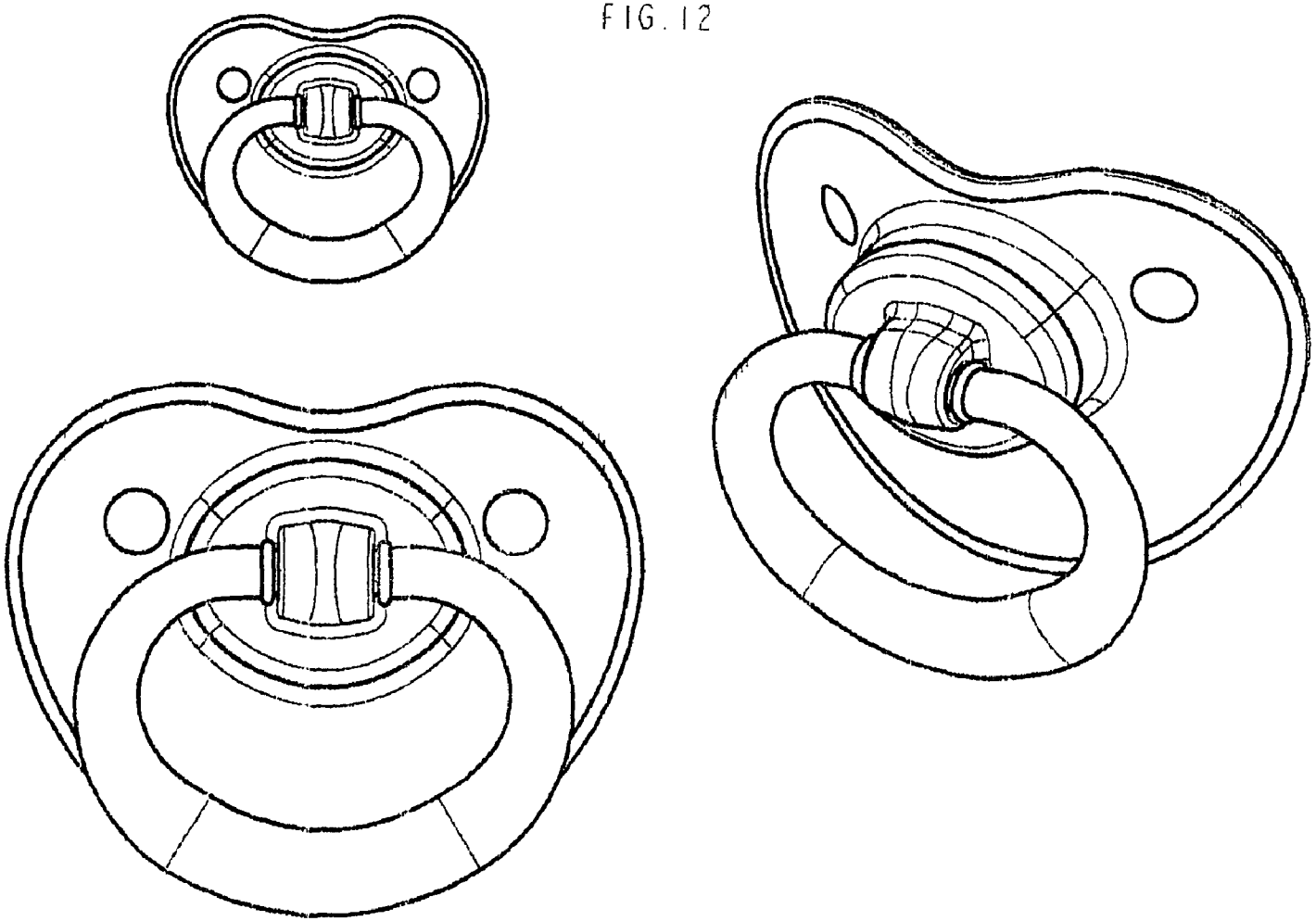
FIG. 12 includes views of an additional pacifier, in accordance with the invention, in which the pacifier is provided with a handle that pivots.
Figure 13:
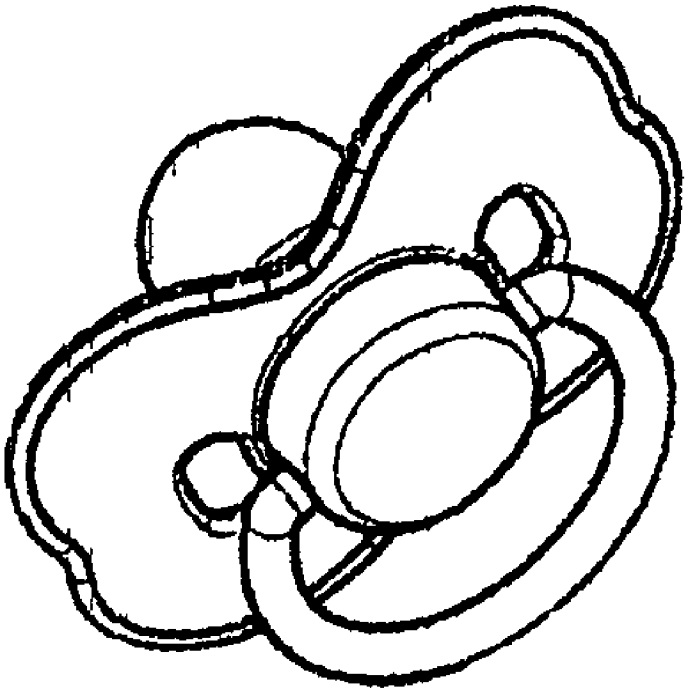
FIG. 13 is a perspective view of a further embodiment of the pacifier of FIG. 12, in which the pacifier is provided with a pivoting handle.

In the preferred embodiment, pacifier 18 or 22 is further provided with a polycarbonate insert post 72 or 76 and a domed cap 64 or 68. Insert post 72 or 76 is placed on one side of a first shield 30 or 34 (e.g. of Kraton) and a second shield 42 or 46 (e.g. of polypropylene), while domed cap 64 or 68 is placed on the opposing side. Specifically, the insert post 72 is snapped onto the shield on one side through the common hole 50 in the shields as shown in FIG. 1 (or through common hole 54, as shown in FIG. 2) and the domed cap 64 or 68 is welded onto the insert post to secure the Kraton shield 30 or 34 to the polypropylene shield 42 or 46. The nipple or baglet of the pacifier (not shown in the figure) extends through the opening in the insert post, e.g. opening 70 in insert post 72. In alternative embodiments of the invention, the pacifier can be provided with a handle, such as a handle that pivots, as shown in FIGS. 12 and 13.

Although Kraton is shown in the figures, in an alternative embodiment, silicone can be substituted. Alternatively, if desired, another suitable soft, flexible material such as a desired thermoset plastic or thermoplastic elastomer could be utilized.

Likewise, other materials can be substituted for the polypropylene component. For example, in alternative embodiments, a polycarbonate shield can be overmolded with a thermoset plastic or a thermoplastic elastomer to provide an alternate multi-component shield having hard and soft shield components.

In a further embodiment, the polypropylene shield 42 can be printed, if desired. Likewise, either a butterfly style shield can be used, as shown in FIG. 1, or an ortho ("nuk") style shield, as shown in FIG. 2. Alternatively, any other shield shape or design, or any other decorative features can be utilized.

In the preferred embodiment, in accordance with the present invention, the polypropylene is sufficiently thin so that it is flexible. In the preferred embodiment, the polypropylene component of the shield is approximately 0.035 inches thick and the kraton component is also approximately 0.035 inches thick, for a total shield thickness of approximately 0.070 inches. In alternate embodiments, the polypropylene and kraton components each range from approximately 0.010-0.040 inches in thickness. Accordingly, in accordance with the invention, even if the child does fall with the pacifier in his or her mouth, besides the buffering provided by the Kraton shield, the flexibility of the polypropylene is such that the pacifier should not break the baby's teeth or provide a hard impact against the baby mouth.

In a further embodiment of the invention, a multi-hardness baglet or nipple is provided, as well. This multi-hardness baglet or nipple can be used, for example, for a pacifier or a baby bottle. Alternatively, this teething item could be used in another desired application. The multi-hardness baglet or nipple includes both softer portions or sections, which are preferably relatively smooth, and harder portions or sections, which are preferably bumps, and are further preferably raised. In accordance with the invention, the harder portions or sections of the baglet or nipple assist the baby in teething. In a further embodiment of the invention, these harder portions can be of a different color than the rest of the baglet or nipple. In yet a further embodiment, these harder portions can be colored, such that a variety of colors of harder bumps are provided, and/or bumps are provided which are different in color from the rest of, or the softer portion of, the baglet.

Any desired shaped baglet or nipple can be made consistent with the invention. Thus, for example, the baglet can be a round baglet, an oval baglet, an orthodontic baglet, a cherry or ball shaped baglet, or any other desired shape. Similarly, the nipple can be in the shape of a standard bottle nipple, an orthodontic nipple, a disposable bottle nipple, a wide neck bottle nipple (i.e. a European style shape, which is approximately 2" in diameter), or any other desired shape.

In accordance with one preferred method of the present invention, Liquid Injection Manufacturing Silicone (LIMS) is utilized to create the baglet or nipple. In this embodiment, an injection machine set up for LIMS is utilized, as is well known in the art. In a preferred embodiment, a standard LIMS machine with two injectors is utilized, one injector being used for the hard material, and one for the soft.

In accordance with this method, a core in the shape of the baglet or nipple is first constructed out of tool steel. This core is placed mechanically or by hand into a first mold cavity, the cavity and the core having been heated to an appropriate process temperature, as is known in the art. For example, for LIM silicone a temperature of approximately 200-400 degrees Celsius can be utilized, and for HCR, a temperature of approximately 100-400 degrees Celsius can be utilized. A standard LIMS mold cavity can be utilized, as is known in the art.

Figure 14:
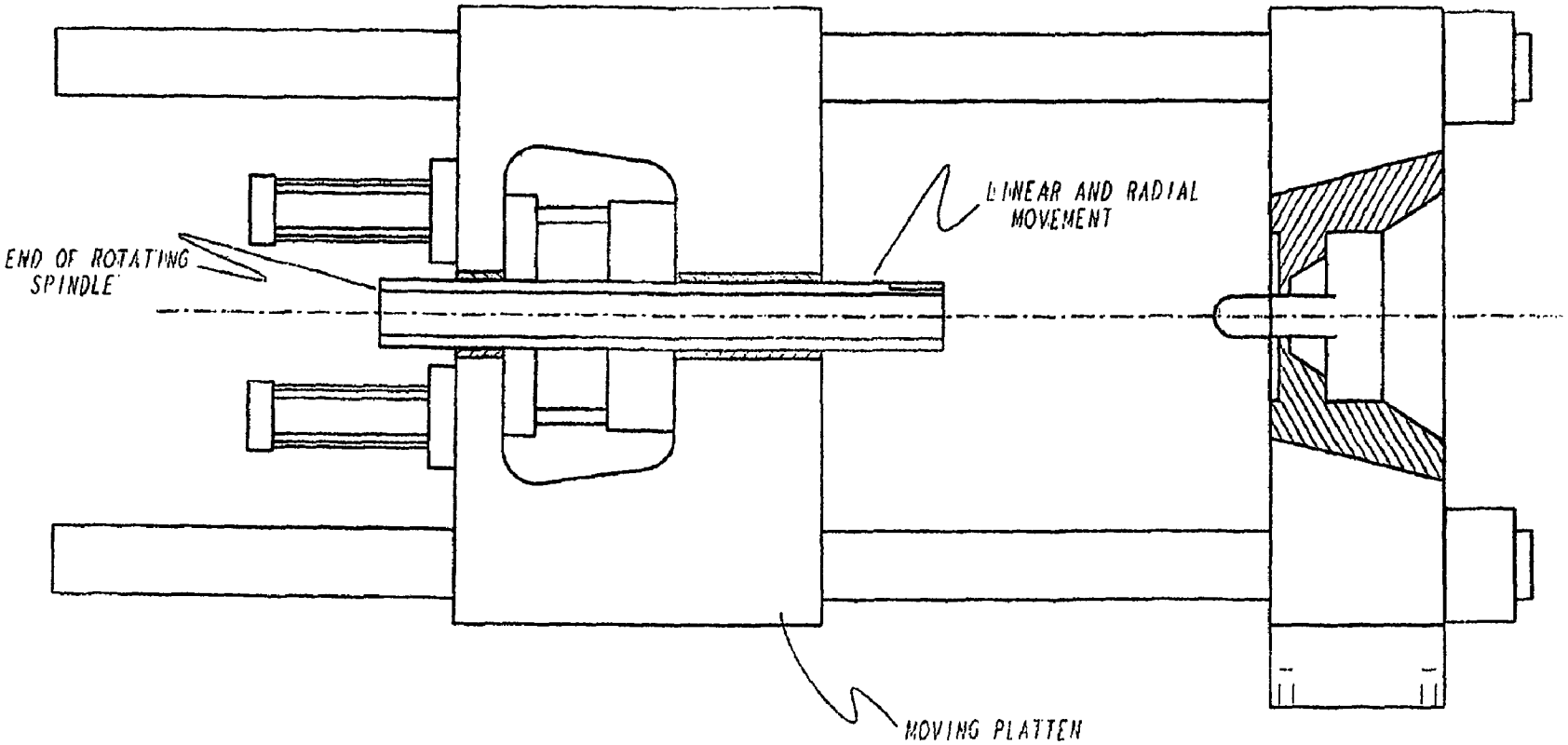
FIG. 14 is a plan view of an injection molding machine, modified for automated production of a baglet in accordance with the present invention.
Figure 19:
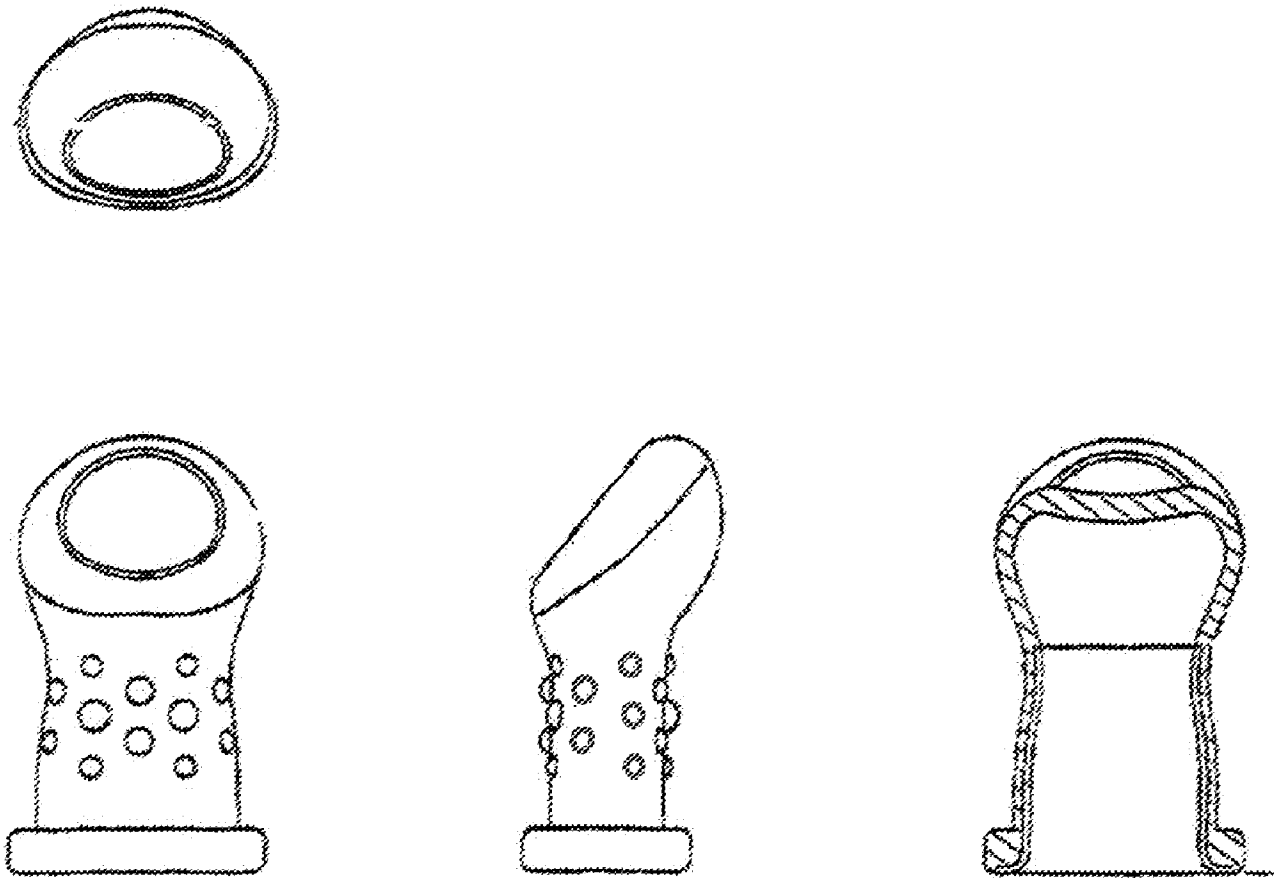
FIG. 19 includes several views of an embodiment of a baglet in accordance with a further embodiment of the invention.
Figure 20:
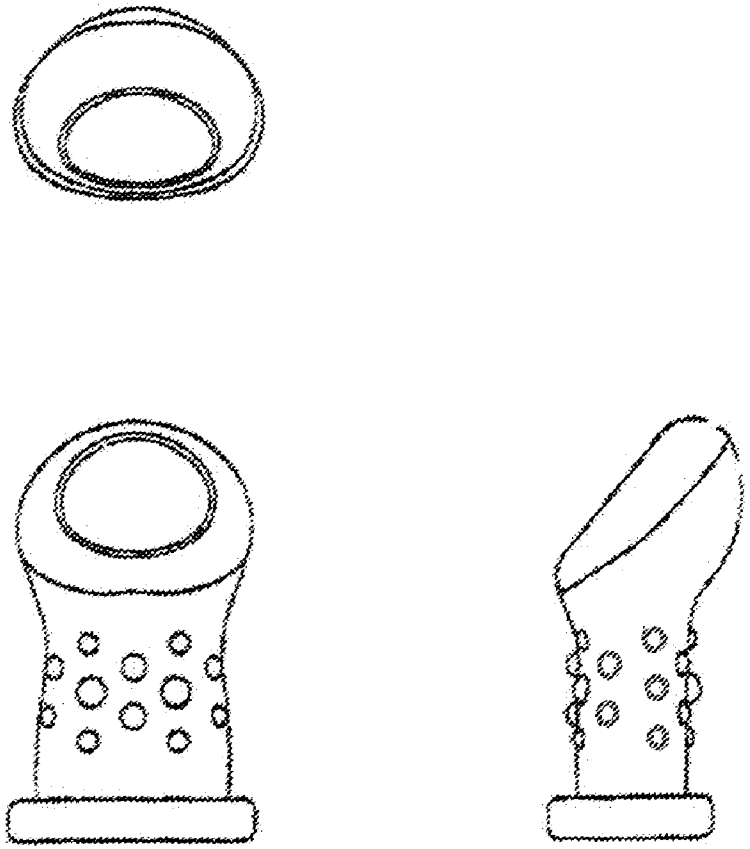
FIG. 20 includes several additional views of the baglet of the embodiment of FIG. 19.
Figure 21:
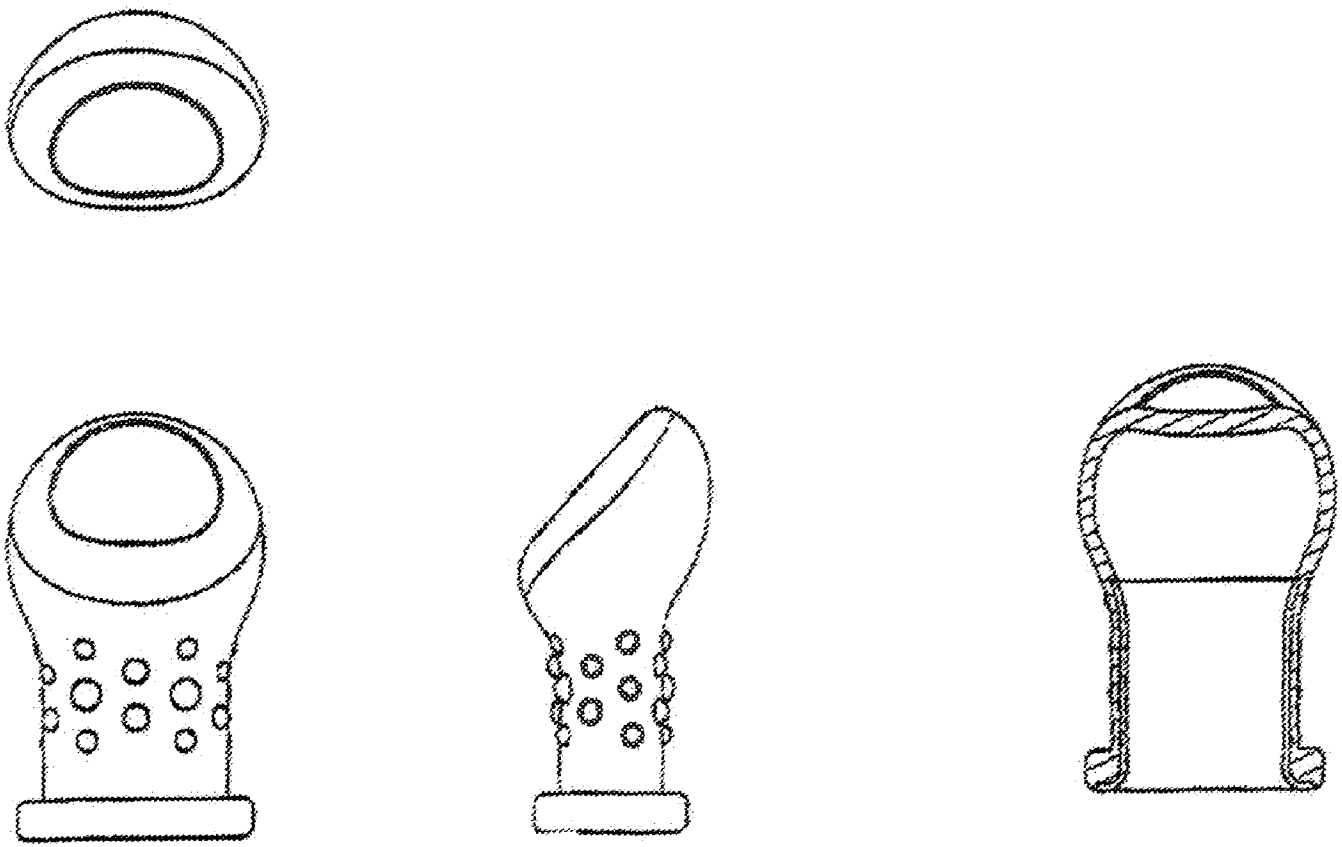
FIG. 21 include several additional views of a baglet in accordance with yet a further embodiment of the invention.
Figure 22:
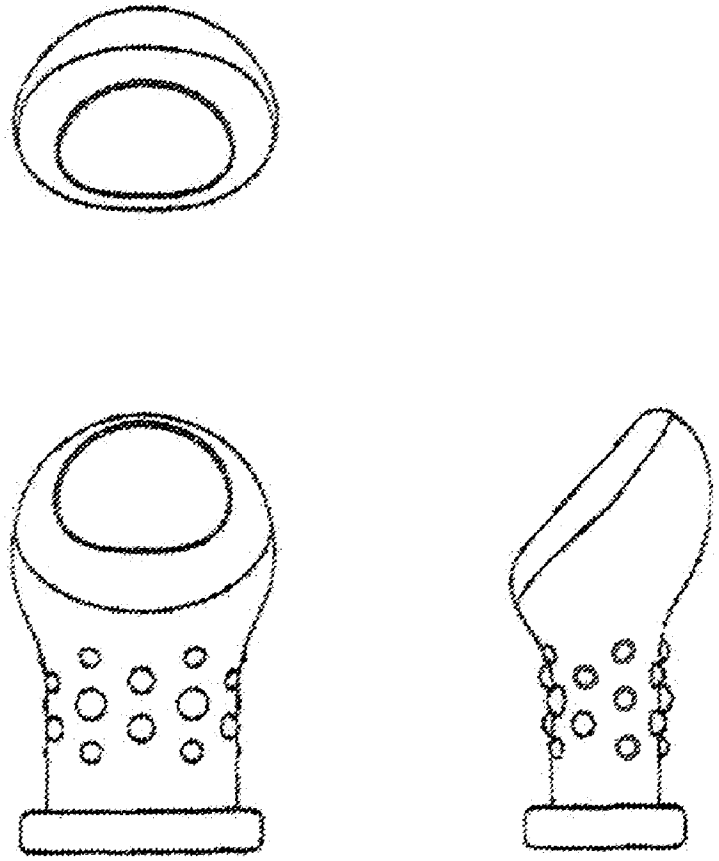
FIG. 22 includes several additional views of the baglet of the embodiment of FIG. 21.

In a preferred embodiment, the standard LIMS machine is modified to assist with the automation of the process. Preferably, the cores are mounted to a bar, which is mounted to a rotating spindle. This spindle is used to places the cores in the mold cavity, and to rotate the cores from one mold cavity to another in an automated fashion. In one embodiment of the invention, the modified machine is a modified Engel, model number ES 330/330/300-20-LIM, injection molding machine. An illustration of this modified configuration of the machine is shown in FIG. 14.

Following placement into the first mold cavity, a first, harder durometer material is injected and molded onto the core. Preferably, this first material is silicone, including, for example, LIM silicone or Heat Cured Rubber (HCR). Alternatively, Kraton, Latex, rubber, or any other suitable desired thermoset plastic or thermoplastic elastomer can be used. In the preferred embodiment, an approximately 40-80 durometer material is used for the first material of the baglet or pacifier. For example, in one embodiment, an approximately 50 durometer material can be utilized.

Figure 4:
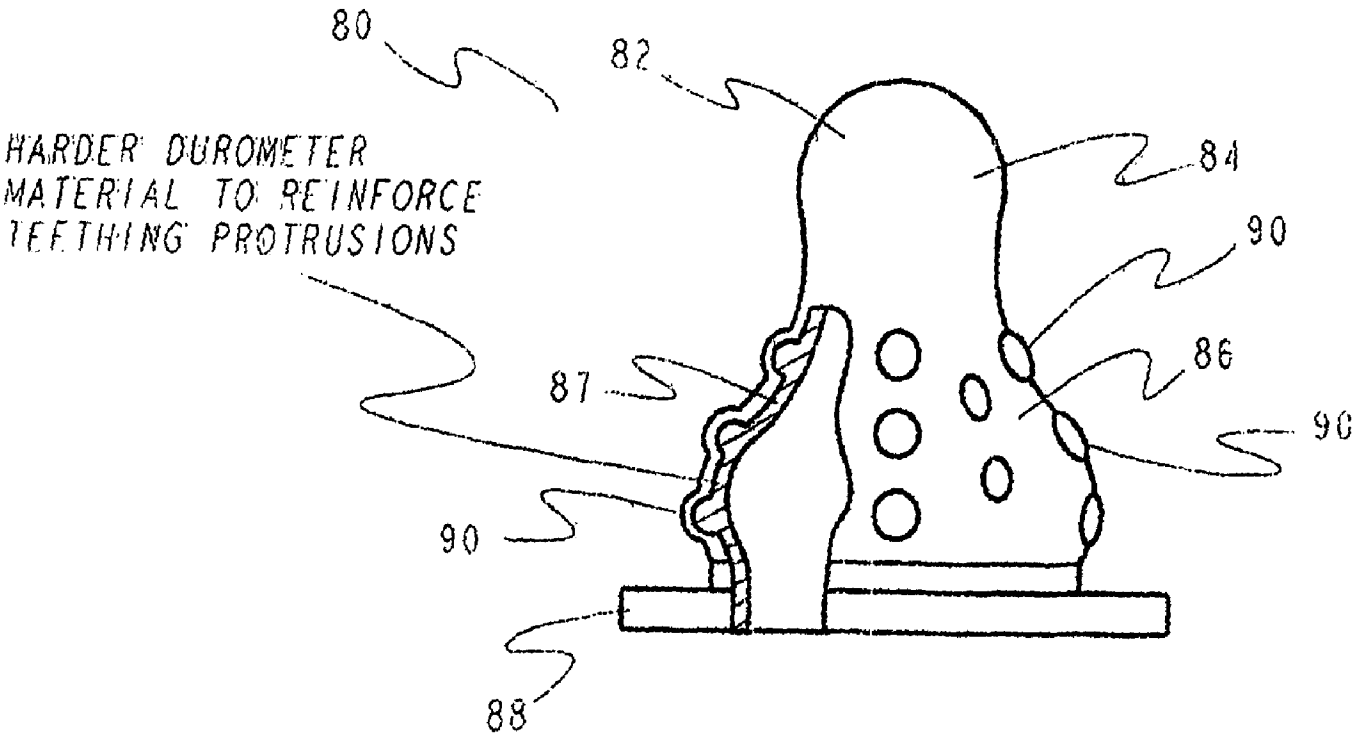
FIG. 4 is a partial cross sectional view of the bottle nipple of FIG. 3.

This first, harder, material is molded with bumps or protrusions, as shown in FIG. 4. These bumps, as disclosed herein, provide a teething surface for an infant to teethe on while using the pacifier.

After injection of the harder durometer material, the core, having the first material molded thereto, is removed by hand or mechanically from that mold and inserted into a second mold cavity. In a preferred embodiment, the spindle rotates and moves forward and backward from a moving platform. The core is then moved by the spindle. The spindle rotates the core approximately 180 degrees toward the second mold cavity, and then moves backward to insert the core into the second mold cavity itself. Preferably, air power and water are configured to run through the center of this spindle to avoid undue tangling or twisting when the spindle rotates and moves.

Once the core has been inserted into the second mold cavity, a second, softer material is then injected and molded onto the core and over the top of the first, harder, durometer material. This second, softer, material can likewise also be silicone, kraton, latex or any other suitable thermoset plastic or thermoplastic elastomer. This second material is softer in hardness than the material chosen for the first layer. For example, in contrast to the first material, the softer material is preferably a material chosen from those in the range of approximately 30-45 durometer materials. In one embodiment, for example, a 45 durometer material can be used.

The second material is injected and molded over the first layer before the first layer cools, to facilitate bonding between the two materials and layers. Accordingly, the first, harder, material is maintained in a heated state until the second material is overmolded to produce a secure bond between the two.

As is known in the art, the particulars of the process, can of course, be modified for the particular material utilized. Thus, while injection into a heated cavity is used for silicone as is known in the art and as described above, alternatively, a standard thermoplastic can be used which is injected into a cold cavity, as is also known in the art. Of course, even with a standard thermoplastic, however, the second material is injected and molded over the first material before the first unduly cools, to facilitate bonding between the two materials.

After injection of the second material onto the core, the mold cavity opens. Preferably the spindle or core remove the core from the mold cavity in an automated fashion. Once the core has been removed from the second mold cavity, the molded material can be removed from the core. On the core, two materials separate materials have bonded, forming a two layer shell which can be removed from the core to provide a baglet or nipple having components of two separate hardnesses which thereby assist a baby in teething.

In the preferred embodiment, the baglet or nipple is mechanically ejected off of the core. In one preferred embodiment, the core is provided with a pin extending therethrough, e.g. through the core's center. Once the components have been molded onto the core, and the core has been removed from the second mold cavity, the pin is mechanically removed or retracted from the core (e.g. through the back of the core), opening the hole extending through the core. Air is then blown through that hole to eject the baglet or nipple off of the core. In one embodiment, a single pin is provided through the core. In an alternate embodiment, a plurality of pins is provided. A single pin can be used, for example, for oval baglets (e.g. wherein the pin is approximately ⅛th of an inch in diameter, although the pin diameter can vary, as desired). A double pin or multiple pins, can be used when it is desirable or necessary to disguide or hide the indentation or witness line from the air injection. For example, 1 mm-3/32 inch diameter pins can be used. A double or multiple pin configuration is useful, for example, for orthodontic baglets. In a further embodiment, however, instead of a retractable pin, an air pop it valve can, alternatively, be used to pop the baglet or nipple off of the core.

Following ejection of the baglet or nipple from the core, post curing can be done, if necessary, using a post curing process. Curing increases the strength of the material, and, more importantly, removes volatile materials to comport with the applicable regulations limiting these products to 0.05% maximum volatiles. A standard post curing protocol can be used in accordance with the normal post curing process for the particular material used in the baglet. For some materials, for example, the LIMS materials provided by General Electric Silicone (GE), no post curing is necessary. With the materials supplied by GE, volatiles are already below the required level, and curing is therefore not needed for removal of volatiles, nor is it needed for strength. Thus with GE LIMS materials, once the baglet or nipple has been ejected from the core it can be assembled into the pacifier or baby bottle. With other materials, however, e.g. the materials provided by Wacker Silicones Corporation of Adrien, Mich., or Bayer Corporation of Pittsburgh, Pa., post curing is necessary, and is conducted according to the standard properties of the particular materials used.

Although the term core is referred to herein in the singular, in all of the embodiments of the method of the present invention multiple cores can be moved simultaneously through the process of the present invention. For example, two or more cores can be simultaneously treated in a first mold cavity (or in a plurality of first mold cavities), and then moved to a second mold cavity or plurality thereof. In this manner, production of a large number of baglets or nipples can be effected at the same time during in each cycle of the process.

In a second embodiment of the method of the present invention, compression molding can be used to construct the present baglets and nipples. This molding can be effected using a thermoset or thermoplastic elastomer. As an example of a suitable thermoset elastomer, HCR can be used, or, as an example of a suitable thermoplastic, Kraton or polyurethane can be used, although the invention is not limited to these materials.

In accordance with this method, a core is first made for molding the elastomer materials and the core is heated as with LIMS. The first, harder, material is then placed into a compression mold, and the mold is dosed to compress the material onto the core. As described above, this first material can be silicone, kraton, latex or any other suitable thermoset or thermoplastic elastomer, preferably a 40-80 durometer material.

After compression of the material onto the core, the core is then removed mechanically or by hand, and moved to a different mold. A second, soft material is placed into the mold and the core is forced into the mold, compressing the soft material into the core and over the harder material. As described above, this second material is silicone, kraton, latex or any other elastomer, preferably a 30-45 durometer material.

Once the second material has been molded onto and bonded to the first, the two layer shell, which forms the shape of a baglet or nipple, is removed from the core. After removal of this baglet or nipple, the finished product can be cured, if necessary. For example, HCR must be cured for clarity, strength, and to remove remaining volatile elements. Accordingly, this step is conducted, as necessary, depending on the materials utilized for the baglet or nipple. Thermoset materials, for example, need to be post cured, while post curing is not necessary for thermoplastics.

In the preferred embodiment of the invention, the thickness of the first, harder, material ranges from is approximately 0.01-0.07 inches from the bottom of this layer to the top of the bumps, i.e. this layer is approximately 0.01-0.07 inches at its thickest section. In one such embodiment, this layer is approximately 0.045 inches in thickness. The thickness of the intermediate areas in this first, harder, layer, i.e. the thickness in the areas between the bumps, is preferably approximately 0.005-0.060 inches in thickness.

With respect to the second, softer material layer, the thickness of this layer is approximately 0.01-0.06 inches in thickness in the thickest area of this soft layer where the bumps are located (also measured from the bottom of this layer to the top of the bumps). The thickness of this second, softer material layer, in the intermediate area where no bumps are located, is approximately 0.005-0.07 inches in thickness. In a preferred embodiment, the baglet or nipple has a uniform wall thickness, with the exception of where the bumps are located.

Figure 9:
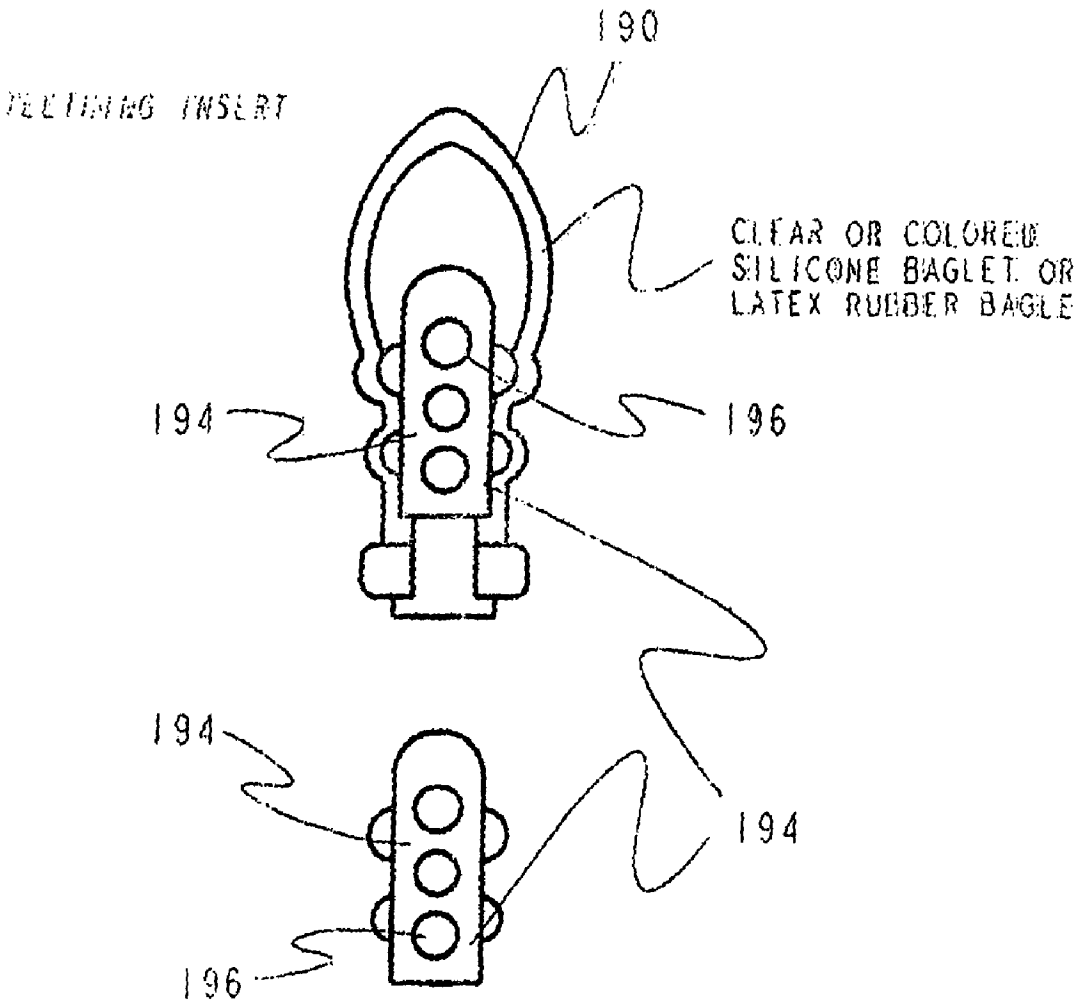
FIG. 9 is a cross sectional view of a further embodiment of a pacifier baglet in accordance with the invention.

In a third method method of constructing the baglet, a two layer baglet can be provided in which a normal baglet 190 has a tube, plug, or other device or layer 194 inserted therein, as shown in FIG. 9. The internal tube inserted into the nipple or baglet has harder bumps 196 located thereon. These bumps press press through the upper layer of the nipple or baglet to assist the baby in teething.

Figure 5:
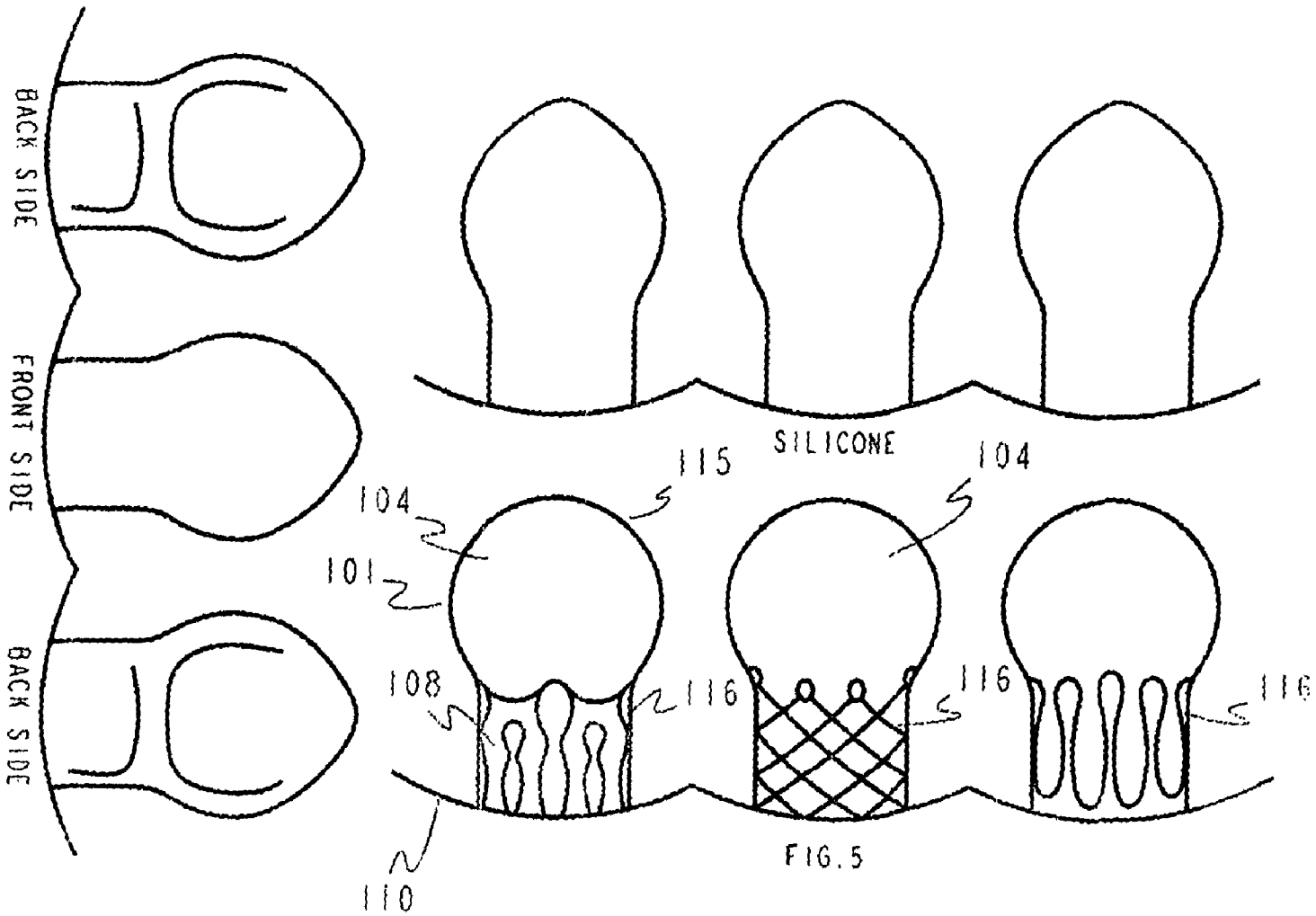
FIG. 5 is a series of views of a pacifier baglet, in accordance with the invention.

Thus, in accordance with the preferred embodiment of the invention, a dual hardness baglet or nipple is provided in which one portion of the baglet is softer and another portion is harder. The harder portion, preferably in the shape of bumps, will massage and rub the child or infant on his or her gums to allow the baby to teethe on the baglet, assisting the baby during the difficult period when his or her teeth are breaking through the gums. As shown in FIG. 5, in the preferred embodiment of the invention this harder portion is located on the lower section of the baglet or nipple, i.e. on the area which will rub up against and massage the baby's gums when the baglet or nipple is located in the baby's mouth. In a further embodiment of the invention, the harder portion is in the form of bumps, such as raised or depressed areas.

Although in the preferred embodiment of the invention, a dual hardness baglet or nipple is provided, i.e. a baglet or nipple of two hardnesses, any multiple number of hardnesses can be provided consistent with the invention herein. In further embodiments, a three-hardness baglet or nipple can be provided having components of three separate hardnesses, or a four-hardness baglet or nipple, or any higher multiple of hardnesses desired.

Figure 3:
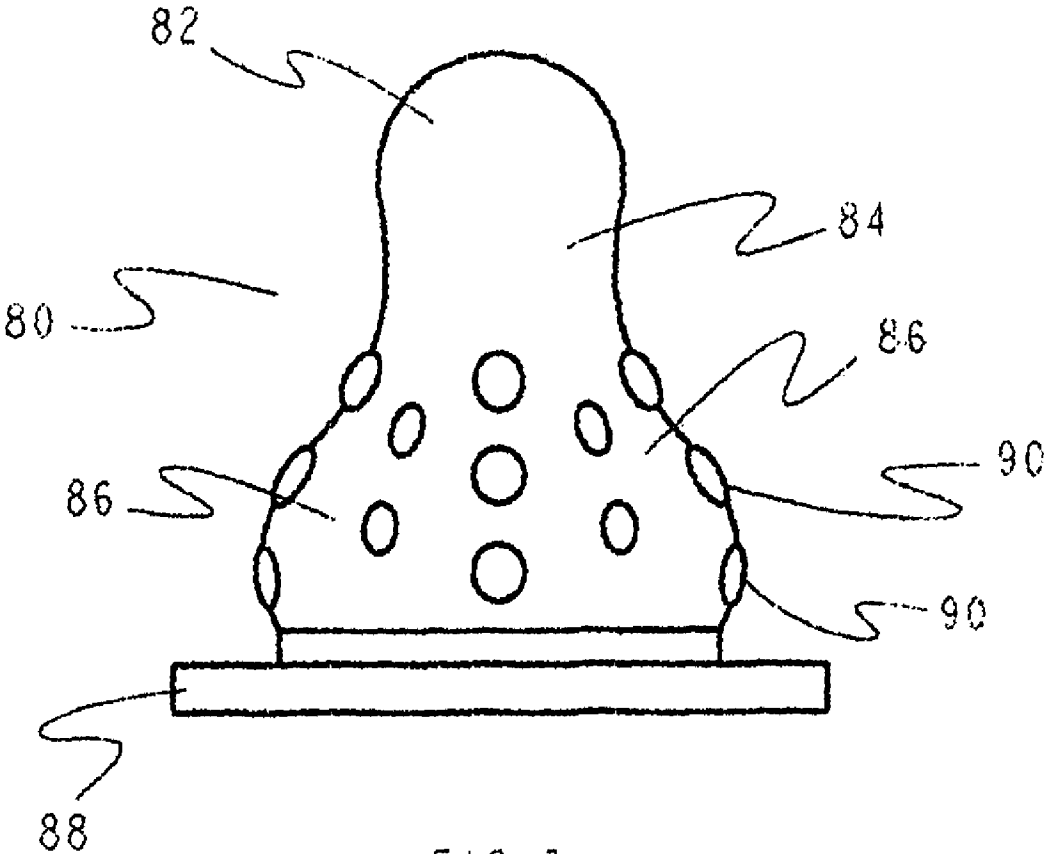
FIG. 3 is a side view of a bottle nipple in accordance with the present invention.
Figure 6:
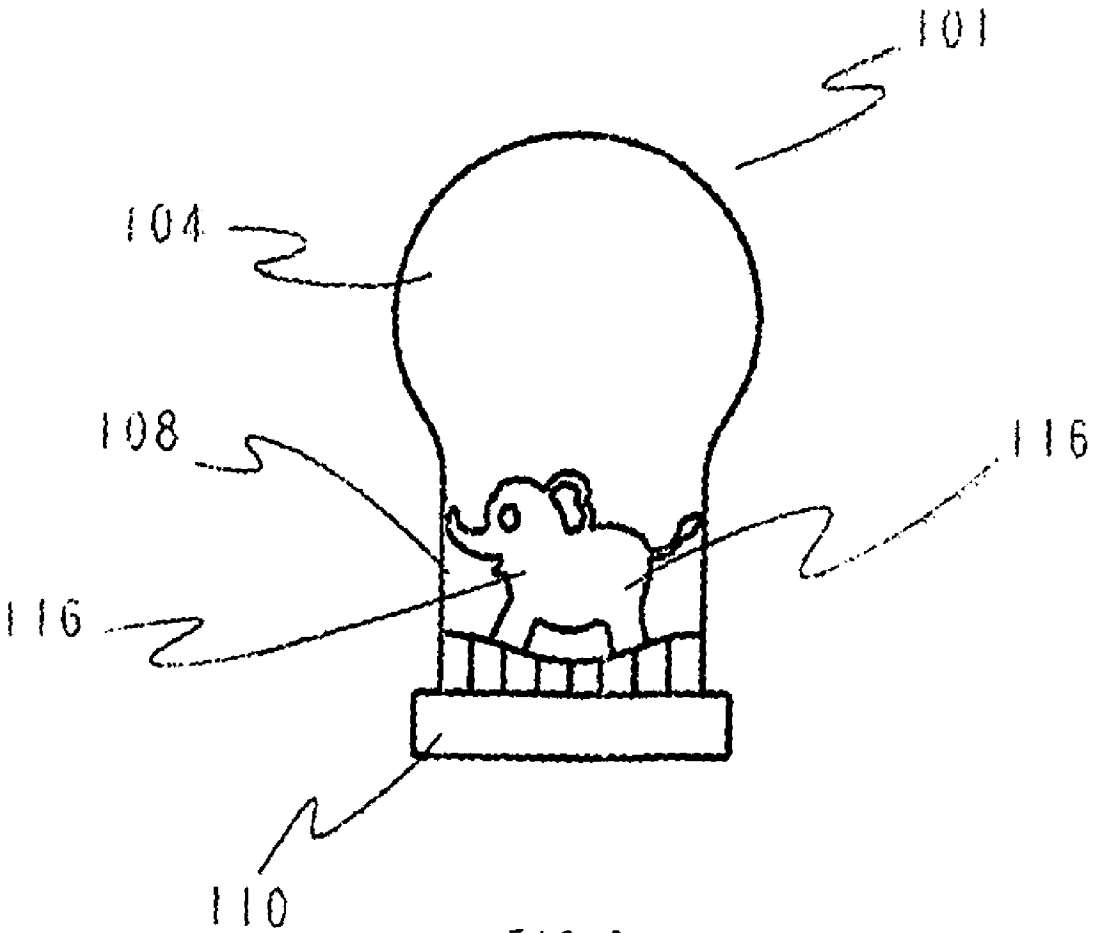
FIG. 6 is a side view of a further embodiment of a pacifier baglet in accordance with the invention.
Figure 7:
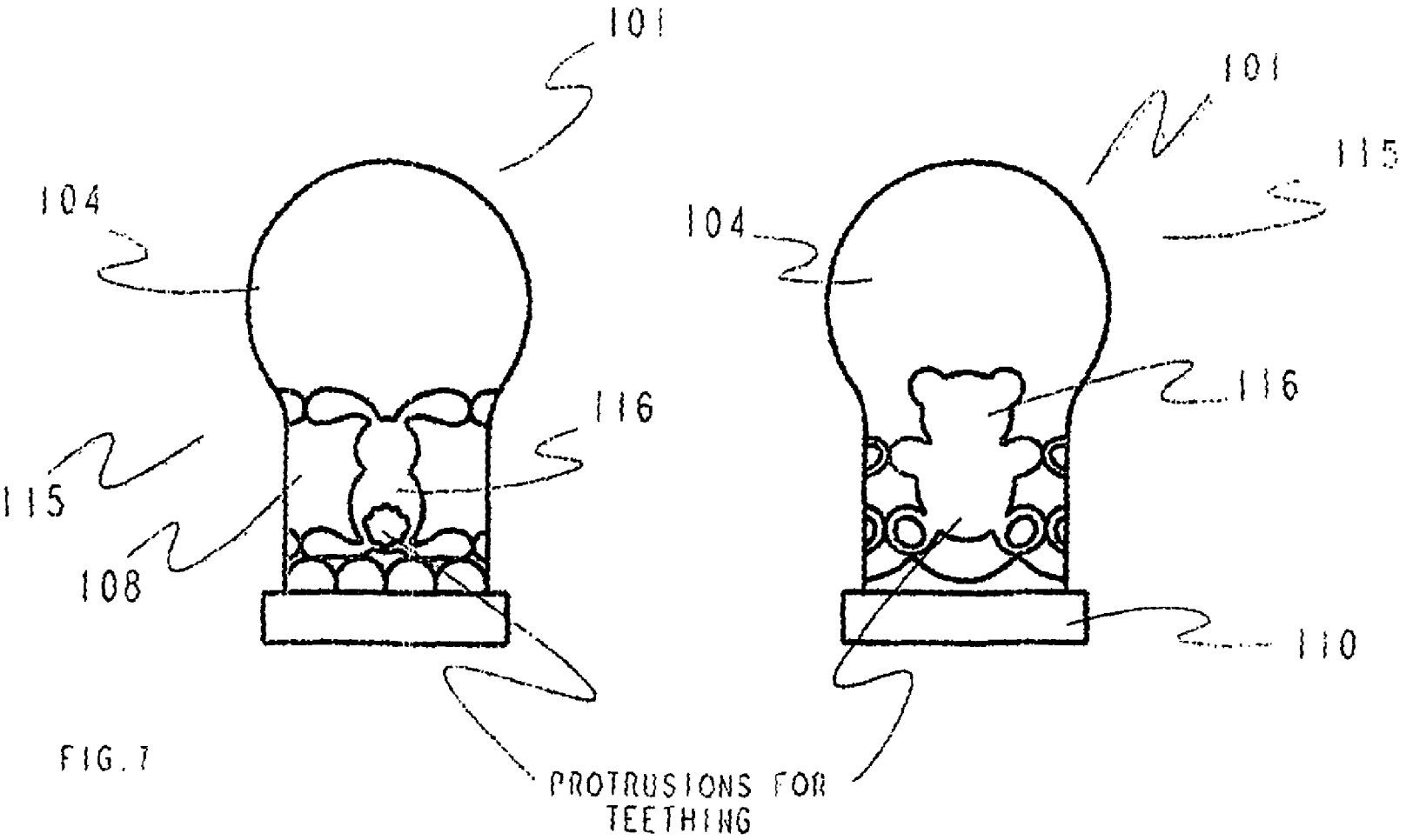
FIG. 7 is a side view of a further embodiment of a pacifier baglet in accordance with the invention.
Figure 8:
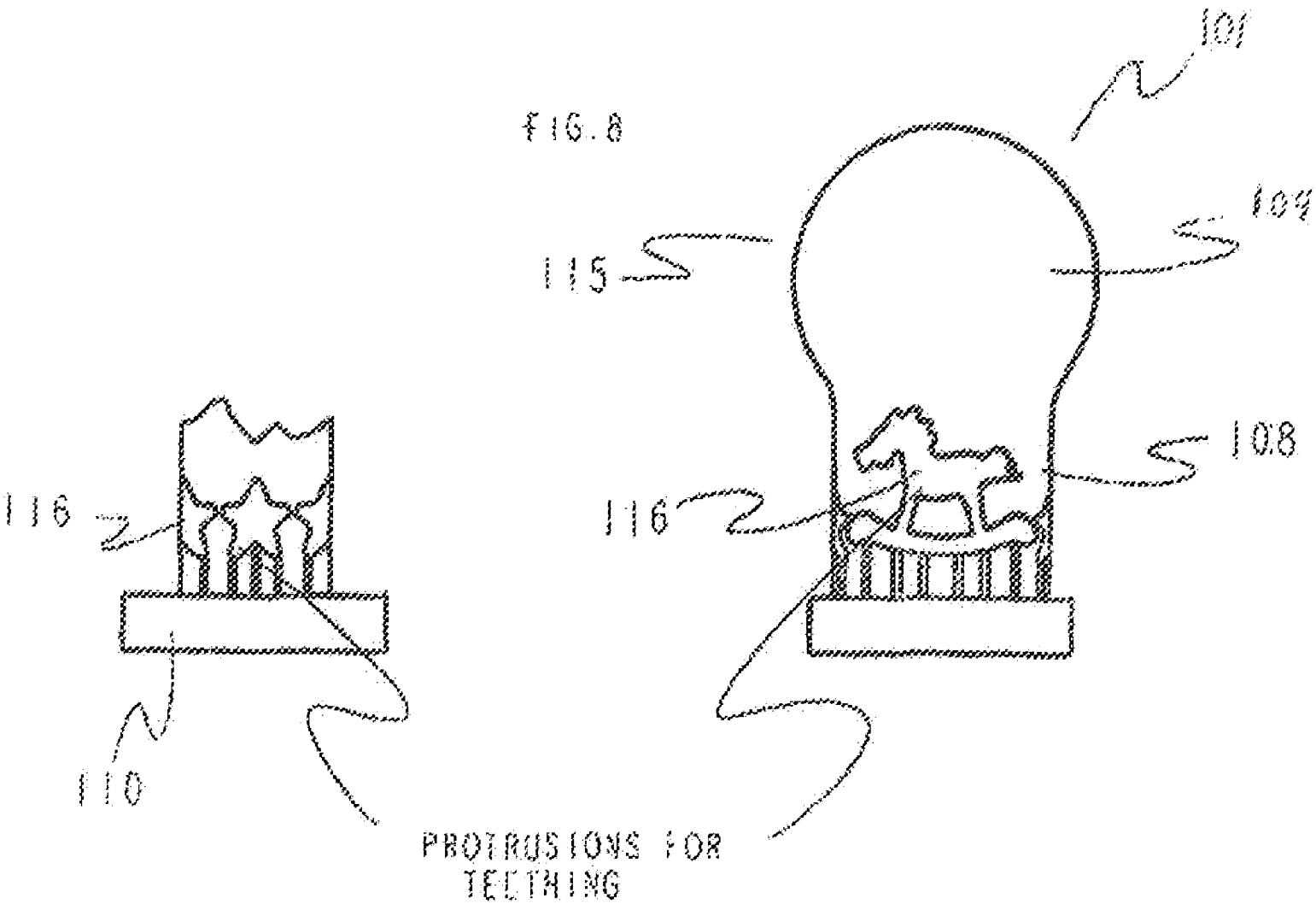
FIG. 8 is a side view of a further embodiment of a pacifier baglet in accordance with the invention.

In an alternative preferred embodiment of the invention, only one material is used for the baglet or nipple. In accordance with this embodiment, this single material is constructed or molded with bumps on it for the child to teethe on, the bumps being of the same hardness as the rest of the baglet or nipple. In this embodiment, the teething baglet or nipple is preferably formed using injection or compression molding, as previously discussed. The baglet or nipple is preferably not made by manufacturing methods such as latex dipping. This teething baglet or nipple is in contrast to prior baglets and nipples in that the baglets or nipples of the invention are molded to have teething sections (bumps) directly provided thereon for rubbing against the gums of the baby. Preferably, these teething sections are on the neck 108 of the pacifier baglet as shown in FIG. 6, and the body 86 of the baby bottle nipple, as shown in FIGS. 3 and 4.

Furthermore, in terms of their interior, the baglets and nipples are like traditional pacifier baglets and baby bottle nipples. In other words, in the preferred embodiments, they are not filled with gel or other liquid, in contrast to teething rings and other teething devices. Rather, the interior of the baglet or nipple of the present invention is free of gel or other liquid. Preferably, the interior is hollow, with only gases such as air therein. Liquid filled internal bladders are preferably not used. Thus, the baglet or nipple is preferably an injection or compression molded item, with teething sections on the outer surface of the baglet or nipple, and with a hollow interior.

In accordance with the invention, this single hardness baglet or nipple is used to accustom a child to the feel or texture of a teething device on his or her gums. The single hardness device is for use whether or not the child is teething yet, and in fact, is preferably used before the child starts teething, as discussed further below. In fact, in a preferred embodiment, the initial pacifier or nipple is provided with teething—like bumps or sections on it, even though the pacifier or nipple is too soft to be used for teething purposes. By starting the infant on this pacifier or nipple early on, the infant is acclimated to the feel of the bumps (or other sections), and is weaned on to this new type of pacifier having this surface configuration and texture. Accordingly, the child can later be provided with a teething pacifier or nipple having the same types of bumps when teething occurs. Since the child has been using a pacifier or nipple with the same sort of bumps for months at that point, the infant does not reject the new teething pacifier or nipple since he or she is already accustomed to it. Yet this subsequent teething pacifier preferably is sufficiently hard (or includes teething portions which are sufficiently hard) so that it serves to assist the baby with teething.

In this manner, baby bottles and pacifiers are provided which assist with the baby's teething, the product "working in the background" while the baby is feeding on the baby bottle or sucking on the pacifier. Thus, while the baby's attention is focused on the natural acts of feeding, the nipple is working on the gums as the teething sections rub against those gums. Similarly, while the baby is in the midst of the comforting act of sucking on the pacifier, the pacifier baglet is likewise working on the baby's gums by rubbing against them. In early stages, this is used to acclimate the baby to the feel of the products, even though teething may still be weeks or months away. In later stages, this is used to assist with the teething of the baby.

As shown in FIGS. 3 and 4, bottle nipple 80 has a rim 88 which supports a lower section or body 86 in an upright position, with body 86 supporting a middle section or neck 84 which supports an upper section or tip 82, in a shape well known in the art. As shown in FIG. 6, pacifier baglet 101 has a rim 110 which supports a lower section or neck 108, with neck 108 supporting an upper section or bulb 104, in a shape also well known in the art. Bottle nipple can be made of any suitable material, such as silicone Kraton, latex, rubber or any other desired thermoset plastic or thermoplastic elastomer, and likewise for the material 115 (FIG. 5) of pacifier baglet 101, as previously discussed.

In accordance with the preferred embodiments of the inventions, lower section or body 86 of the nipple 80 and lower section or neck 108 of the pacifier are each provided with teething areas, as shown in the figures. Specifically, in the preferred embodiment of the baby bottle nipple 80, bumps, teething protrusions or areas for teething 90 are located on body 86 of nipple 80, as shown in FIGS. 3 and 4. A layer 87 of harder durometer material can be provided under the surface of the nipple 80 to reinforce the teething protrusions 90, as shown in FIG. 4. In the preferred embodiment of the pacifier baglet, bumps, teething protrusions or areas for teething 116 are located on neck 108 of the pacifier baglet, as shown, for example, in FIG. 6.

In one embodiment of the invention, whether in the multiple hardness teething baglets or nipples or with the single hardness teething baglet or nipple, the bumps are in the form of nubs or protuberances. In a further embodiment of the invention, the bumps of the nipple or baglet are in the form of other geometric shapes, including, for example, simple geometric designs such as ovals, or squares or triangles, or the shapes of images or characters, such as cartoon characters (e.g. Mickey Mouse®), or animal characters (e.g. small bears or ducks), or so forth, as shown in FIGS. 5-8. If desired, the bumps can be provided in a combination or assortment of such shapes on each baglet or nipple. Moreover, although, in the preferred embodiment, the bumps herein are raised and protrude above the surface of the baglet or nipple, in an alternate embodiment, the bumps discussed in the present application can be provided in the form of depressions or indentations. In this alternate embodiment, the intermediate region between the bumps are greater in height than the bumps themselves, which are depressed into the baglet or nipple surface. This alternate embodiment, in which the bumps are in the form of depressions, can also be used for effective teething purposes.

Figure 10:
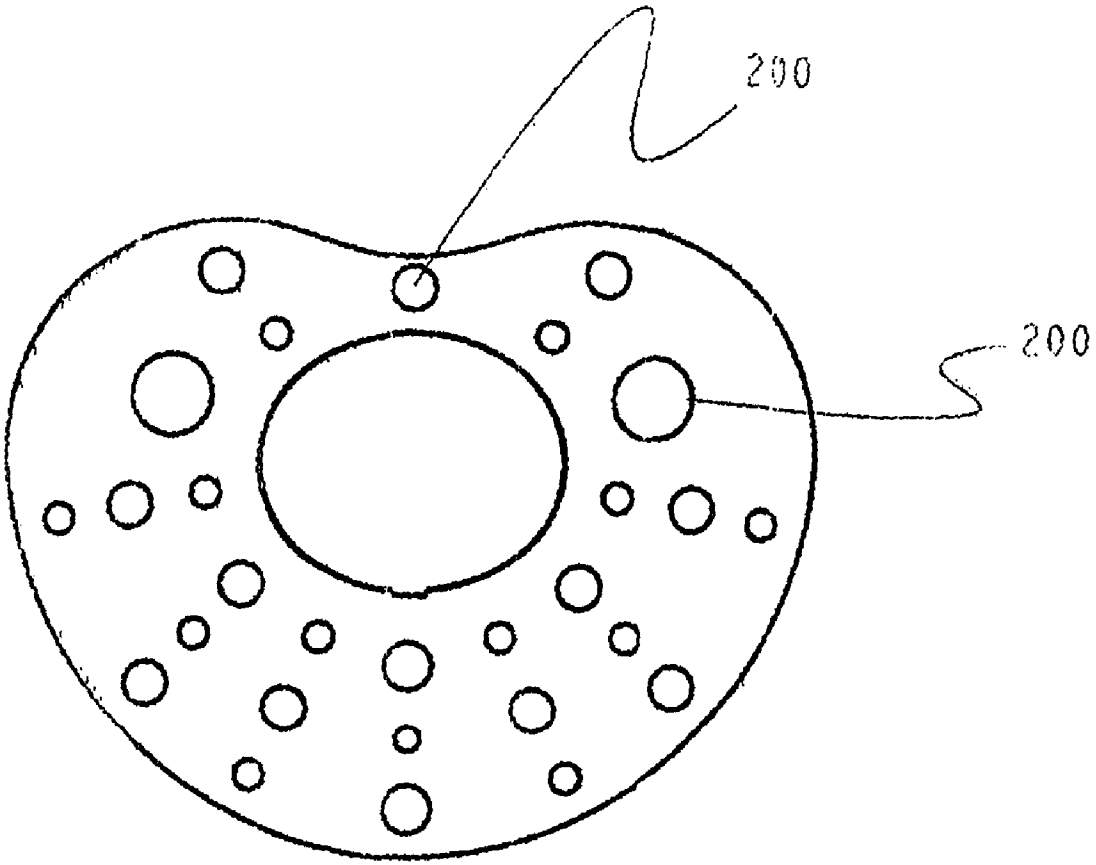
FIG. 10 is a top view of a pacifier shield, in accordance with a further embodiment of the present invention.
Figure 11:
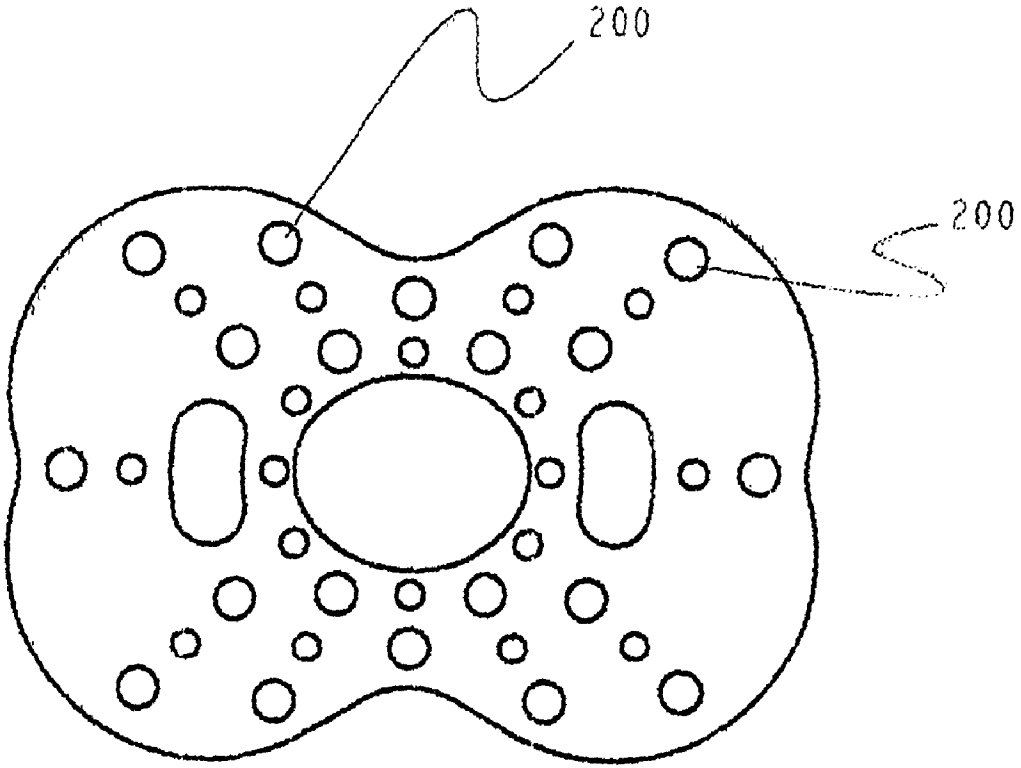
FIG. 11 is a top view of a further embodiment of a novel pacifier shield, in accordance with the invention.

In a further embodiment of the invention, pacifier shields are provided as shown in FIGS. 10-11. These shields are provided with small bumps 200 on the surface of the shield which rests against the baby's face. It is believed that these bumps or nubs may provide air gaps between the shield and the child's skin. Two separate embodiments of the design of these bumps or protuberances 200 and of the shapes of the shield are shown in FIGS. 10 and 11, although other embodiments of the design of these bumps can be used consistent with the invention.

In a further alternative or additional embodiment of the invention, a multistage baglet system is provided for a pacifier (or nipple for a baby bottle). In this multistage baglet system, baglets with bumps thereon are provided to accustom a baby to the use of such a baglet, and then baglets are subsequently provided to assist the baby with teething. In the preferred embodiment, four stages are provided, although more or less can be provided consistent with the invention.

In this embodiment, a first stage baglet is provided such as shown in FIGS. 15A and 15B, the baglet having bumps thereon. The baglet is a "single hardness baglet", such single hardness baglets also being referred to as a "Type I" baglet. In other words, the baglet is one wherein the bumps of the baglet are not provided with a second, harder material for teething. The bumps are preferably provided on the baglet's neck.

In the method and apparatus of the invention, the first stage baglet of the invention is provided for the use of newborns and other young babies up to the time that they start to teethe. Thus, the bumps on the baglet are not provided for teething purposes (since the baby is too young to teethe), but rather to accustom the baby to having the bumps in the baby's mouth, to the rubbing of the bumps against the gums, and to the overall feel of the baglet. A baglet of the same overall softness as baglets currently used in the art can be provided for the first stage; the soft nature of the baglet and the bumps is immaterial since teething is not an object.

In accordance with the invention, a second stage baglet is subsequently provided to the baby when the baby begins to teethe, as shown in FIG. 16. This second stage baglet is preferably a "Type II" or "multiple hardness baglet", i.e. a baglet of a first material with bumps that include a second, harder, material, as previously discussed herein. The bumps of the second stage baglet include a harder material for teething purposes, so that when these bumps rub against the baby's gums, the teething of the baby is further facilitated. This second stage baglet is preferably the same size as the first stage baglet, but, in contrast, in this stage the bumps are now provided on the baglet to cause the baby to teethe thereon.

Subsequently, as the baby continues to grow and continues to teethe, a third stage baglet is provided to the baby, as shown in FIG. 17. This third stage baglet is also a Type II or multiple hardness baglet provided for teething purposes (as with the second stage baglet). However, in accordance with the invention, it is preferred that the third stage baglet be larger than the second stage baglet due to the increased size of the baby.

Once the baby completes teething, the baby can be switched to a fourth stage baglet, as shown in FIGS. 18A and 18B. This fourth stage baglet is a Type I or a single hardness baglet, as with the first stage baglet, but is of a relatively larger size. Preferably, the size of the fourth stage baglet is the same as or approximately the same as that of the third stage baglet. Since this baglet is not provided for teething, but is intended to be a post-teething device, this baglet is not a multiple hardness baglet. At the same time, since the baby has been accustomed to the use of a baglet with bumps, the baglet is still provided with bumps (although not for teething), so that the baby does not reject the baglet.

As a result, a multiple stage baglet system is provided for acclimating a baby to the use of a baglet with bumps thereon, and then for assisting the baby with teething. In accordance with one preferred embodiment of the invention, a single hardness baglet or nipple is provided having bumps or protrusions thereon for acclimating an infant to the feel of the bumps on the baglet or nipple.

In a further preferred embodiment of the invention, at least two stages are provided, an initial stage baglet wherein the bumps are the same hardness as the baglet, and a subsequent stage wherein the bumps include or comprise a harder material to facilitate teething. Thus, pursuant to a preferred embodiment of the system and method of the invention, a manufacturer or company provides at least two stages of baglets to a parent or other caregiver for the use of a child.

More than two stages can also be provided consistent with the invention. In the preferred embodiment, as discussed above, a four stage system is provided, wherein the stages take into account the increasing size of the baby. In that preferred embodiment, the first and fourth baglets are Type I baglets wherein the bumps do not include any harder material therein for teething. The second and third baglets are Type II baglets, wherein the bumps do include a harder material therein for teething. Further in the preferred embodiment, the first and second baglets are a first size, and the third and fourth baglets are a second, relatively larger size. Thus, the preferred embodiment is summarized in the following chart:

| | Smaller size | Larger size |
|---|---|---|
| Type I | $1^{st}$ stage baglet | $4^{th}$ stage baglet |
| Type II | $2^{nd}$ stage baglet | $3^{rd}$ stage baglet |

The baglets of these embodiments can also be any shape baglet known in the art. It is further preferred that the shape of the baglet be consistent through the different stages provided to the baby, since the first shape provided to the baby will be the one that he or she will grow accustomed to.

In a further embodiment of the invention, baby bottle nipples with bumps can likewise be provided in a multiple stage system in the same manner as set forth above for baglets. In other words, a $1^{st}$ stage, $2^{nd}$ stage, $3^{rd}$ stage and $4^{th}$ stage baby bottle nipple can likewise be provided. One or more stages can be provided. Preferably, at least two stages are provided, an initial stage baglet wherein the bumps are the same hardness as the baglet, and a subsequent stage wherein the bumps include or comprise a harder material to facilitate teething. Thus, pursuant to a preferred embodiment of the system and method of the invention, a manufacturer or company provides at least two stages of baglets to a parent or other caregiver for the use of a child.

Figure 23:
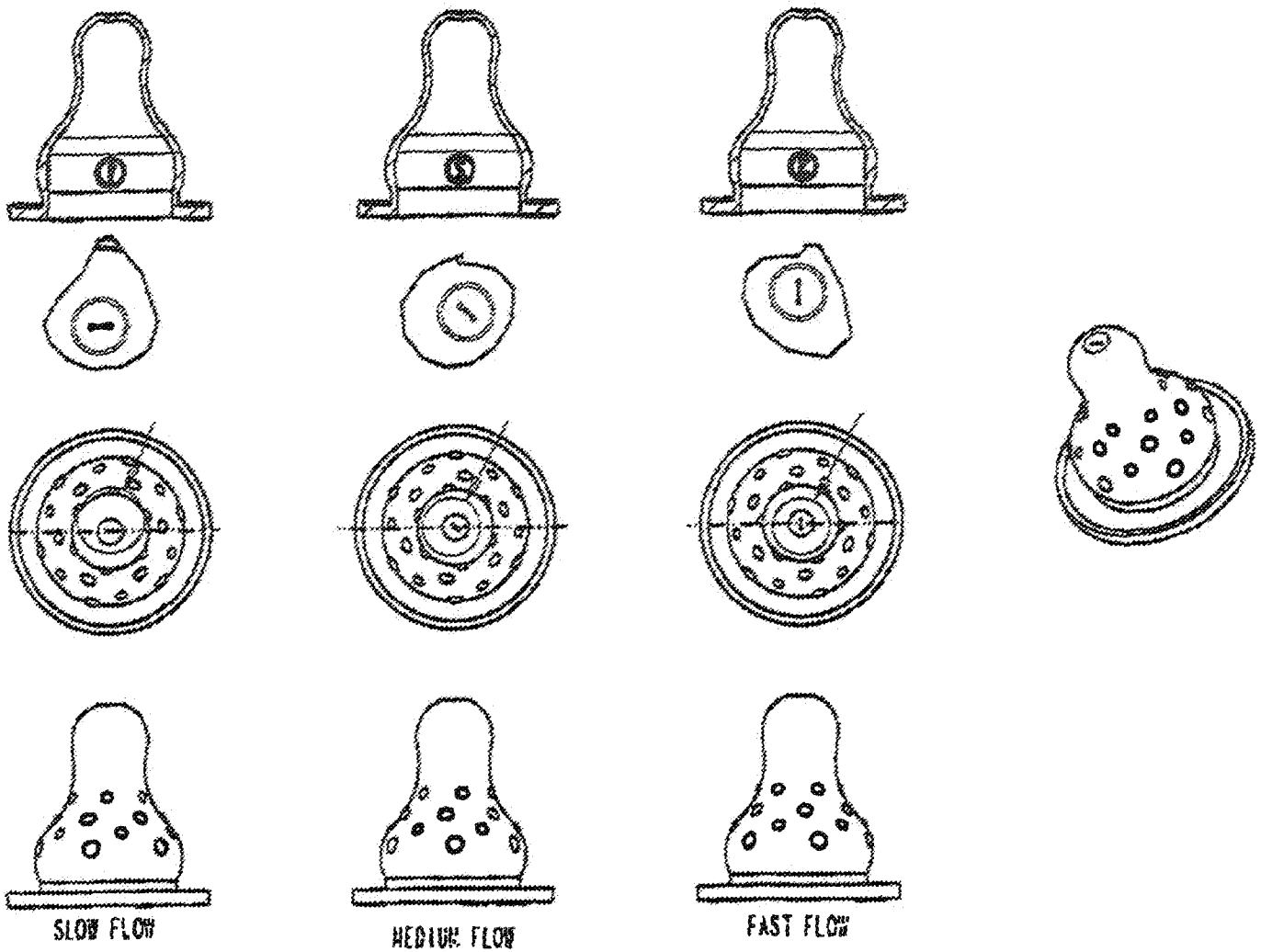
FIG. 23 includes several views of an embodiment of a variable flow level nipple, in accordance with a further embodiment of the invention.
Figure 24:
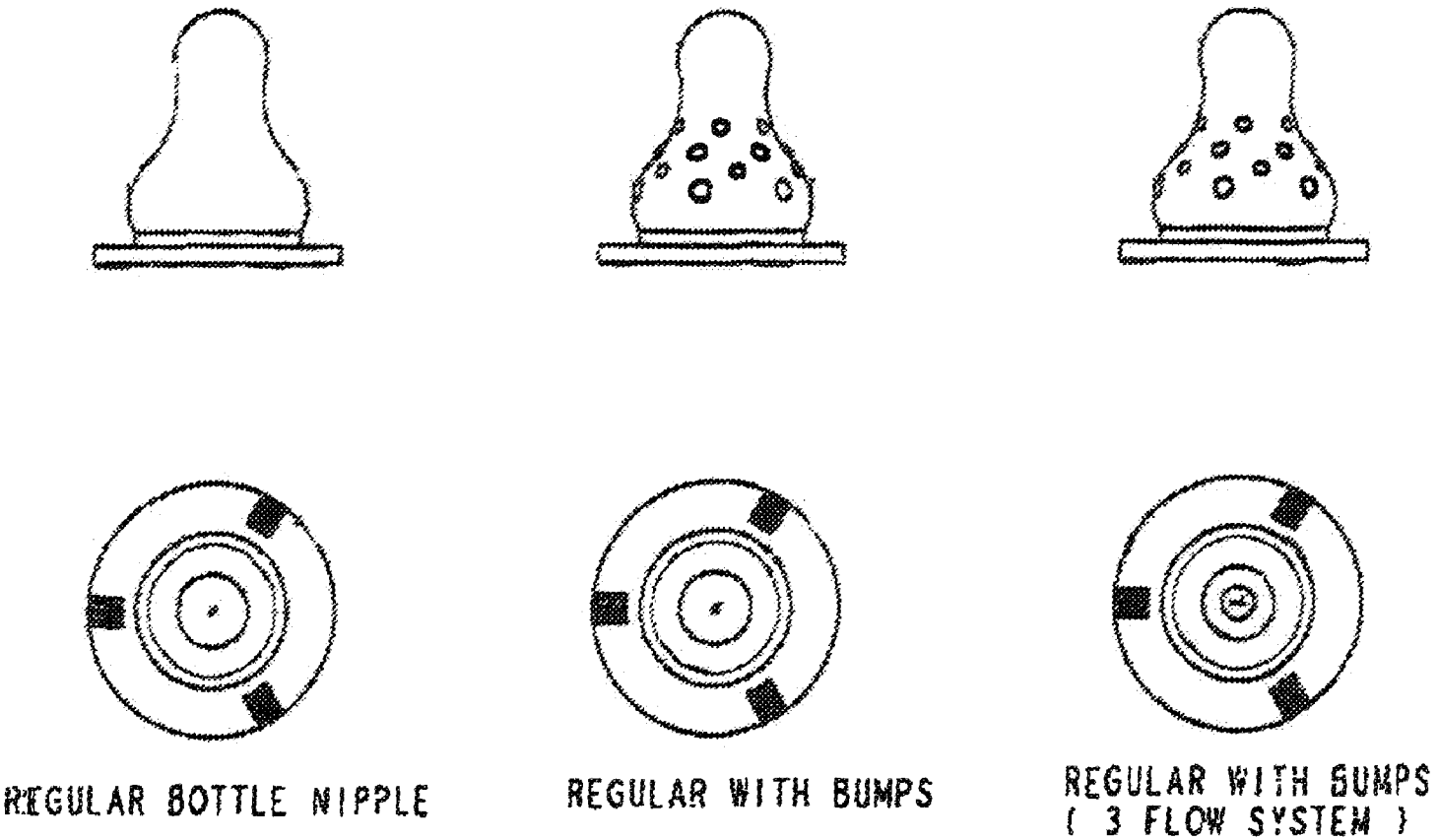
FIG. 24 includes several additional views of further preferred embodiments of the invention.
Figure 25:
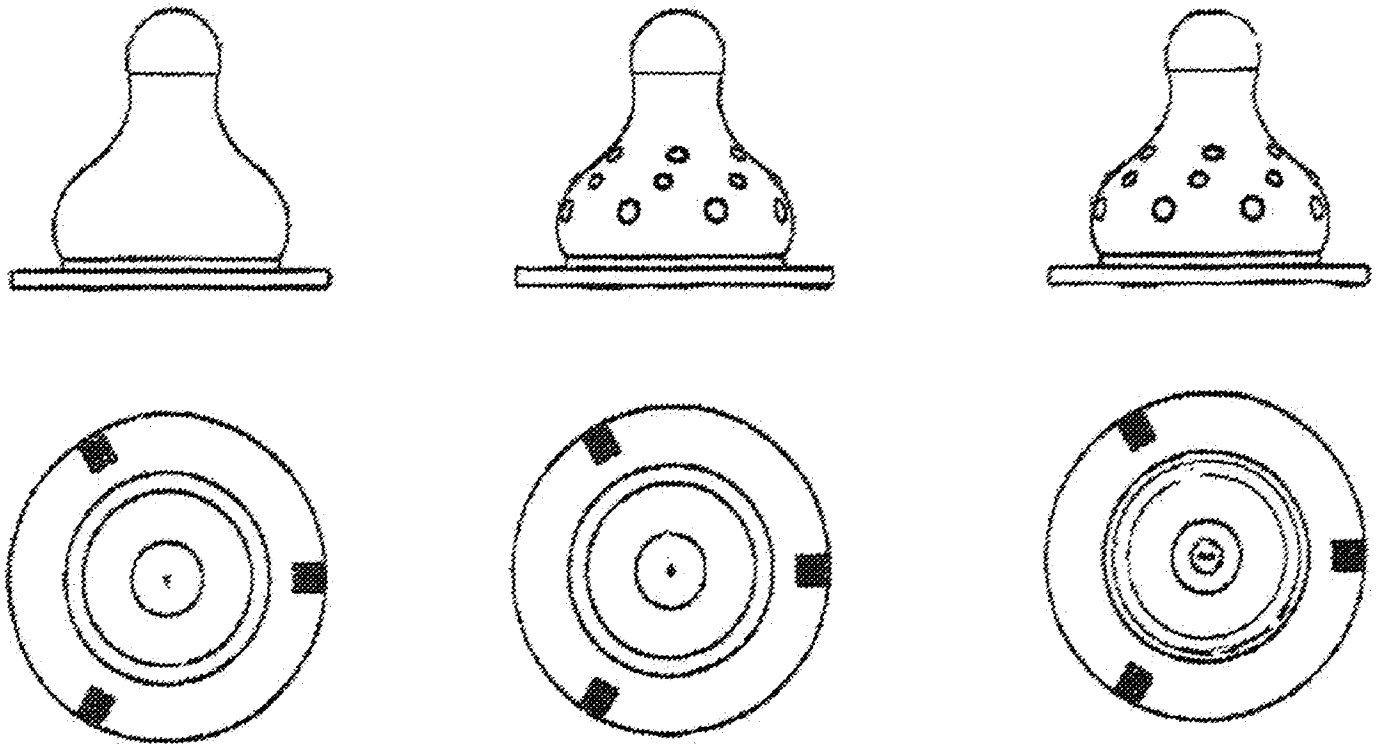
FIG. 25 includes several additional views of yet further embodiments of the invention.

More than two stages can also be provided consistent with the invention. In the preferred embodiment, as discussed above, a four stage system is provided, wherein the stages take into account the increasing size of the baby. In that preferred embodiment, the first and fourth baglets are Type I baglets wherein the bumps do not include any harder material therein for teething. The second and third baglets are Type II baglets, wherein the bumps do include a harder material therein for teething. Further in the preferred embodiment, the first and second baglets are a first size, and the third and fourth baglets are a second, relatively larger size. Thus, the preferred embodiment is summarized in the following chart:

Additionally or alternatively, those nipples be provided with multiple flow levels as shown in FIGS. 23-25. As shown, for example, in FIG. 23, the baby bottle nipples with bumps can be provided to the consumer with the choice of multiple flow levels, e.g. as a slow flow nipple, a medium flow nipple, or a fast flow nipple. The techniques for making such nipples are well known in the art. In these embodiments, the flow rate through the baglet can be adjusted based on the orientation of the nipple. Those nipples can be provided with bumps (both as Type I and Type II embodiments) and of different sizes.

The nipples and pacifiers baglets of these embodiments can also be any shaped nipples and baglets known in the art. Whatever shape is utilized, it is greatly preferred that the shape be consistent through the different stages provided to the baby; the first shape provided to the baby will be the one that he or she will grow accustomed to, and the baby will likely reject any other type thereafter.

Having described this invention with regard to specific embodiments, it is to be understood that the description is not meant as a limitation since further embodiments, modifications and variations may be apparent or may suggest themselves to those skilled in the art. It is intended that the present application cover all such embodiments, modifications and variations.

What is claimed is:

1. A method of manufacturing a pacifier comprising the steps of:

(a) constructing a pacifier with a pacifier shield out of at least a first material and a second material, said first material and said second material of said pacifier shield having different hardnesses with respect to each other such that said first material is a harder material and said second material is a softer material;

(b) constructing a first component of said pacifier shield out of said first, harder, material, wherein said first component comprises a first hole;

(c) constructing a second component of said pacifier shield out of said second softer, material, wherein said second component comprises a second hole;

(d) placing said second component of said second, softer, material above said first component of said first, harder, material, such that said pacifier shield comprises a first side comprising said first component and a second side comprising said second component, and such that said second, softer, material, is positioned to rest next to a child's face when the child uses said pacifier;

(e) inserting a baglet and a post through said first hole and said second hole; and, (f) permanently affixing a cap to said pacifier, wherein said cap is positioned on said first side, and wherein said cap is coupled with said post.

2. A method as claimed in claim 1, wherein said pacifier shield is made using compression molding.

3. A method as claimed in claim 1, wherein said pacifier shield is made using injection molding.

4. A method as claimed in claim 1, wherein said pacifier shield is made using transfer molding.

5. A method as claimed in claim 1, wherein said second, softer, material is molded onto said first, harder material.

6. A method as claimed in claim 1, wherein said pacifier shield comprises two pacifier shields that are attached together.

7. A method as claimed in claim 1, wherein said first component further comprises a first pacifier shield, and said second component further comprises a second pacifier shield.

8. A method as claimed in claim 1, wherein said first side is an opposing side to said second side.

9. A method as claimed in claim 1, wherein said cap is a domed cap.

10. A method as claimed in claim 1, wherein said cap is permanently affixed to said post.

* * * * *